US009897360B2

(12) United States Patent
Yura

(10) Patent No.: US 9,897,360 B2
(45) Date of Patent: Feb. 20, 2018

(54) REFRIGERATION APPARATUS

(71) Applicant: DAIKIN INDUSTRIES, LTD., Osaka-shi, Osaka (JP)

(72) Inventor: Yoshinori Yura, Berkeley, CA (US)

(73) Assignee: Daikin Industries, Ltd., Osaka (JP)

( * ) Notice: Subject to any disclaimer, the term of this patent is extended or adjusted under 35 U.S.C. 154(b) by 185 days.

(21) Appl. No.: 14/773,133

(22) PCT Filed: Mar. 6, 2014

(86) PCT No.: PCT/JP2014/055746
§ 371 (c)(1),
(2) Date: Sep. 4, 2015

(87) PCT Pub. No.: WO2014/136865
PCT Pub. Date: Sep. 12, 2014

(65) Prior Publication Data

US 2016/0018148 A1 Jan. 21, 2016

(30) Foreign Application Priority Data

Mar. 8, 2013 (JP) ..... 2013-046882

(51) Int. Cl.
*F25B 43/02* (2006.01)
*F25B 41/00* (2006.01)
(Continued)

(52) U.S. Cl.
CPC ..... *F25B 49/022* (2013.01); *F04B 39/02* (2013.01); *F04B 39/023* (2013.01);
(Continued)

(58) Field of Classification Search
CPC .. F04B 39/02; F04B 2400/01; F04B 2500/16; F04B 2500/27; F04B 31/002; F04C 29/028
(Continued)

(56) References Cited

U.S. PATENT DOCUMENTS 3,705,499 A * 12/1972 Mount ..... F25B 31/002 62/192
4,066,869 A * 1/1978 Apaloo ..... F04B 39/0207 184/104.1
(Continued)

FOREIGN PATENT DOCUMENTS

CN 102679507 A 9/2012
JP 9-170826 A 6/1997
(Continued)

OTHER PUBLICATIONS

International Preliminary Report of corresponding PCT Application No. PCT/JP2014/055746 dated Sep. 17, 2015.
(Continued)

*Primary Examiner* — Henry Crenshaw
(74) *Attorney, Agent, or Firm* — Global IP Counselors, LLP

(57) ABSTRACT

A refrigeration apparatus includes a compressor and a controller. The compressor has a casing and a compression element. Compressed refrigerant is sent out of the casing after being discharged into an internal space of the casing. An oil sump formed in the casing collects refrigerator oil. A heater heats the refrigerator oil collected. The controller controls the heater while the refrigeration apparatus is stopped so that a temperature of the refrigerator oil collected in the oil sump reaches a first oil temperature target value. The first oil temperature target value is set in order to keep a refrigerant condensation amount of the refrigerant equal to or less than an allowable condensation amount at which the concentration or viscosity of the refrigerator oil needed to lubricate the compressor can be maintained. The refrigerant condensation amount is caused by in-dome condensation at the start of operation of the refrigeration apparatus.

4 Claims, 9 Drawing Sheets

(51) Int. Cl.

| | |
|---|---|
| ***F25D 17/06*** | (2006.01) |
| ***F25B 31/00*** | (2006.01) |
| ***F25B 49/00*** | (2006.01) |
| ***F25B 49/02*** | (2006.01) |
| ***F04C 23/00*** | (2006.01) |
| ***F04B 39/02*** | (2006.01) |
| ***F04C 29/02*** | (2006.01) |
| ***F04C 29/04*** | (2006.01) |
| ***F25B 13/00*** | (2006.01) |
| *F04C 18/02* | (2006.01) |

(52) U.S. Cl.
CPC ..... *F04C 23/008* (2013.01); *F04C 29/028* (2013.01); *F04C 29/04* (2013.01); *F25B 13/00* (2013.01); *F25B 31/002* (2013.01); *F25B 49/005* (2013.01); *F04C 18/0215* (2013.01); *F04C 2270/195* (2013.01); *F25B 2313/0233* (2013.01); *F25B 2400/01* (2013.01); *F25B 2500/16* (2013.01); *F25B 2500/27* (2013.01); *F25B 2500/31* (2013.01); *F25B 2700/1931* (2013.01); *F25B 2700/1933* (2013.01); *F25B 2700/21151* (2013.01); *F25B 2700/21152* (2013.01); *F25B 2700/21155* (2013.01)

(58) Field of Classification Search
USPC ..... 62/113, 190, 192, 197, 228.1, 472, 84
See application file for complete search history.

(56) References Cited

U.S. PATENT DOCUMENTS

| | | | | |
|---|---|---|---|---|
| 4,208,883 | A * | 6/1980 | Stirling | F04B 39/0207 62/192 |
| 4,444,017 | A * | 4/1984 | Briccetti | F04B 39/04 184/6.22 |
| 4,506,519 | A * | 3/1985 | Morse | F25B 43/00 62/190 |
| 4,755,657 | A * | 7/1988 | Crim | F04B 39/0207 219/536 |
| 5,012,652 | A * | 5/1991 | Dudley | F04B 39/00 62/192 |
| 6,615,597 | B1 * | 9/2003 | Domyo | F25B 13/00 62/197 |
| 6,672,102 | B1 * | 1/2004 | Huenniger | F25B 1/047 62/472 |
| 2005/0252224 | A1 * | 11/2005 | Umeoka | F04B 39/0207 62/228.1 |
| 2007/0175212 | A1 * | 8/2007 | Uno | F01C 13/04 60/519 |
| 2010/0162742 | A1 | 7/2010 | Shimoda et al. | |
| 2012/0102989 | A1 * | 5/2012 | Gov | F25B 40/00 62/113 |
| 2012/0210742 | A1 | 8/2012 | Kato et al. | |
| 2012/0227430 | A1 | 9/2012 | Takeuchi et al. | |

FOREIGN PATENT DOCUMENTS

| | | | |
|---|---|---|---|
| JP | 10-148405 | A | 6/1998 |
| JP | 2000-130865 | A | 5/2000 |
| JP | 2001-73952 | A | 3/2001 |
| JP | 2004-116794 | A | 4/2004 |
| JP | 2005-351590 | A | 12/2005 |
| JP | 4111246 | B2 | 4/2008 |
| JP | 2011-102674 | A | 5/2011 |

OTHER PUBLICATIONS

International Search Report of corresponding PCT Application No. PCT/JP2014/055746 dated Jun. 10, 2014.

European Search Report of corresponding EP Application No. 14 75 9593.8 dated Nov. 3, 2016.

* cited by examiner

REFRIGERATION APPARATUS

CROSS-REFERENCE TO RELATED APPLICATIONS

This U.S. National stage application claims priority under 35 U.S.C. § 119(a) to Japanese Patent Application No. 2013-046882, filed in Japan on Mar. 8, 2013, the entire contents of which are hereby incorporated herein by reference.

TECHNICAL FIELD

The present invention relates to a refrigeration apparatus, and particularly to a refrigeration apparatus comprising a compressor having a structure in which refrigerant compressed by a compression element is sent out of a casing after being discharged into an internal space of the casing in which an oil sump for collecting refrigerator oil is formed, a heater for heating the refrigerator oil collected in the oil sump, and a controller for controlling the heater.

BACKGROUND ART

Conventionally, refrigeration apparatuses have included air-conditioning apparatuses used to cool and heat room interiors of buildings or the like by performing a vapor-compression refrigeration cycle.

In this type of refrigeration apparatus, when the temperature of the refrigerator oil is low while the refrigeration apparatus has stopped and the pressure of refrigerant in the compressor is under a certain condition, the amount of refrigerant dissolved in the refrigerator oil in the compressor increases. When there is an overlap of conditions such as the refrigeration apparatus being out of operation for a long period of time and/or a change in the refrigerant temperature (or the outdoor temperature), it causes a phenomenon known as stagnation, and a large amount of refrigerant dissolves in the refrigerator oil inside the compressor. When the refrigerant stagnates in the refrigerator oil and the concentration of the refrigerator oil decreases, there is a risk that the viscosity of the refrigerator oil will decrease and the compressor will not be sufficiently lubricated.

In conventional practice, to prevent refrigerant stagnation in the compressor, a countermeasure has been employed in which a heater is attached to the outer periphery of the compressor, and the refrigerator oil inside the compressor is heated while the refrigeration apparatus has stopped to ensure that the refrigerant does not stagnate. There are also cases in which the refrigerator oil inside the compressor is heated by open-phase current conduction to the motor.

However, when current is conducted to the heater in order to heat the refrigerator oil inside the compressor while the refrigeration apparatus has stopped, a certain amount of power is consumed as standby power, and the amount of power consumed by the refrigeration apparatus is increased.

SUMMARY

To reduce such standby power of the refrigeration apparatus, for example, Japanese Laid-open Patent Application No. 2001-73952 and Japanese Patent Publication No. 4111246 disclose the specifics of controlling a heater while a compressor is stopped (i.e, while a refrigeration apparatus is stopped) on the basis of refrigerant temperature and/or outside air temperature. Japanese Laid-open Patent Application No. H9-170826 discloses the specifics of controlling a heater while a refrigeration apparatus is stopped on the basis of the concentration of refrigerator oil inside a compressor.

With heater control such as Japanese Laid-open Patent Application No. 2001-73952, Japanese Patent Publication No. 4111246 and Japanese Laid-open Patent Application No. H9-170826, standby power can be reduced more than in cases in which refrigerator oil inside a compressor is constantly heated while a refrigeration apparatus is stopped.

However, under the condition of a low outside air temperature, even if the concentration (viscosity) of refrigerator oil while the refrigeration apparatus is stopped can be maintained by heater control such as Japanese Laid-open Patent Application No. 2001-73952, Japanese Patent Publication No. 4111246 and Japanese Laid-open Patent Application No. H9-170826, because the temperature of refrigerator oil inside the compressor and/or the temperature of the compressor casing are low, the occurrence of in-dome condensation is prominent, in which refrigerant that has been discharged into the internal space of the casing from a compression element for compressing refrigerant is condensed in the internal space before being sent out of the casing when the refrigeration apparatus starts operating. In-dome condensation occurs when the compressor is structured such that refrigerant compressed by the compression element is sent out of the casing after being discharged into the internal space of the casing in which an oil sump for collecting refrigerator oil is formed, and is a phenomenon in which refrigerant discharged from the compression element into the internal space of the casing at the start of operation of the air-conditioning apparatus is cooled to a state of saturation in the channel leading out of the casing, and the refrigerant condenses on the surface of refrigerator oil collected in the oil sump and/or on the surrounding wall surface of the casing. When the liquid refrigerant produced by such in-dome condensation then dissolves in the refrigerator oil collected in the oil sump, there is a risk that when the refrigeration apparatus starts operating, the concentration (viscosity) of the refrigerator oil will decrease, the compressor will not be sufficiently lubricated, and the compressor will be unreliable.

As a solution to such in-dome condensation, Japanese Laid-open Patent Application No. 2000-130865 discloses the specifics of providing a wall-surface heating passage for channeling refrigerant discharged from a compressor to a wall surface of a compressor casing, and channeling the refrigerant discharged from the compressor to the wall-surface heating passage to heat the wall surfaces of the casing when the compressor is started up (i.e. when the refrigeration apparatus starts operating). However, because the refrigerant discharged from the compressor at the start of operation of the air-conditioning apparatus is low in temperature and near a state of saturation, providing the wall-surface heating passage still does not yield heating capacity sufficient to heat the wall surface of the casing at the start of operation of the air-conditioning apparatus, and it is difficult to suppress decreases in refrigerator oil concentration (viscosity) caused by in-dome condensation.

An object of the present invention is to provide a refrigeration apparatus that can minimize the standby power of the refrigeration apparatus as well as improve the reliability of the compressor while taking into account the decrease in refrigerator oil concentration (viscosity) caused by in-dome condensation.

A refrigeration apparatus according to a first aspect comprises a compressor having a structure in which refrigerant compressed by a compression element is sent out of a casing after being discharged into an internal space of the casing in which an oil sump for collecting refrigerator oil is formed, a heater for heating the refrigerator oil collected in the oil sump, and a controller for controlling the heater. In a compressor having a single-stage compression element, the phrase "a structure in which refrigerant compressed by a compression element is sent out of a casing after being discharged into an internal space of the casing in which an oil sump for collecting refrigerator oil is formed" herein means a structure referred to as a "high-pressure dome" in which refrigerant compressed by a compression element is sent out of a casing after being discharged into an internal space of the casing in which an oil sump is formed. In a compressor having a multiple-stage compression element, this phrase means an "intermediate-pressure dome" or a "high-pressure dome" in which refrigerant compressed by an intermediate-stage and/or a final-stage compression element is sent out of a casing after being discharged into an internal space of the casing in which an oil sump is formed. The term "heater" means a crank case heater for heating refrigerator oil collected in the oil sump from the external periphery of the casing, and/or a motor for driving the compression element when open-phase current conduction is used to heat the refrigerator oil collected in the oil sump. The controller controls the heater while the refrigeration apparatus is stopped so that the temperature of the refrigerator oil collected in the oil sump reaches a first oil temperature target value for keeping a condensation amount of the refrigerant equal to or less than an allowable condensation amount at which the concentration or viscosity of the refrigerator oil needed to lubricate the compressor can be maintained, the refrigerant condensation amount being caused by in-dome condensation at the start of operation of the refrigeration apparatus. The term "in-dome condensation" herein means a phenomenon in which the refrigerant discharged from the compression element into the internal space at the start of operation of the refrigeration apparatus is condensed in the internal space before being sent out of the casing.

While the refrigeration apparatus is stopped, the refrigerator oil collected in the oil sump is heated herein so that the temperature of the refrigerator oil reaches a first oil temperature target value accounting for the decrease in the refrigerator oil concentration (viscosity) caused by in-dome condensation at the start of operation of the refrigeration apparatus, whereby the refrigerator oil concentration (viscosity) needed to lubricate the compressor can be maintained at the start of operation of the refrigeration apparatus even if in-dome condensation occurs. The power consumption of the heater, and consequently the standby power of the refrigeration apparatus, can be reduced by limiting the extent of the heating of the refrigerator oil collected in the oil sump to the first oil temperature target value.

It is thereby possible herein to minimize the standby power of the refrigeration apparatus as well as improve the reliability of the compressor while taking into account the decrease in the concentration (viscosity) of the refrigerator oil caused by in-dome condensation.

A refrigeration apparatus according to a second aspect is the refrigeration apparatus according to the first aspect, wherein the controller decides the allowable condensation amount on the basis of the amount of the refrigerator oil collected in the oil sump while the refrigeration apparatus is stopped, and decides the first oil temperature target value so that the refrigerant condensation amount caused by the in-dome condensation is equal to or less than the allowable condensation amount.

The extent of the decrease in the concentration (viscosity) of refrigerator oil caused by in-dome condensation is determined on the basis of the amount of refrigerator oil collected in the oil sump while the refrigeration apparatus is stopped, and the refrigerant condensation amount caused by in-dome condensation.

In view of this, as described above, the allowable condensation amount is decided on the basis of the amount of refrigerator oil collected in the oil sump while the refrigeration apparatus is stopped, and the first oil temperature target value is decided so that the refrigerant condensation amount caused by in-dome condensation is equal to or less than the allowable condensation amount.

An appropriate first oil temperature target value can thereby be obtained herein.

A refrigeration apparatus according to a third aspect is the refrigeration apparatus according to the first or second aspect, wherein while the refrigeration apparatus is stopped, the controller decides a second oil temperature target value at which the concentration or viscosity of the refrigerator oil collected in the oil sump in a state of solution equilibrium can be maintained at a concentration or viscosity of the refrigerator oil needed to lubricate the compressor, and controls the heater so that the temperature of the refrigerator oil collected in the oil sump reaches the higher value of the first oil temperature target value and the second oil temperature target value. The term "a state of solution equilibrium" herein means a state in which the refrigerant in the refrigerator oil collected in the oil sump reaches saturation solubility at the pressure of the refrigerant in the internal space of the casing.

While the refrigeration apparatus is stopped, the refrigerator oil collected in the oil sump is heated until the temperature of the refrigerator oil reaches the oil temperature target value (i.e., the higher value of the first oil temperature target value and the second oil temperature target value) which takes into account the decrease in refrigerator oil concentration (viscosity) while the refrigeration apparatus is stopped as well as the decrease in refrigerator oil concentration (viscosity) caused by in-dome condensation at the start of operation of the refrigeration apparatus, whereby the concentration or viscosity of the refrigerator oil needed to lubricate the compressor can be maintained throughout the stopping of the refrigeration apparatus and the start of operation of the refrigeration apparatus.

It is thereby possible to minimize the standby power of the refrigeration apparatus as well as improve the reliability of the compressor while taking into account the decrease in refrigerator oil concentration (viscosity) caused by in-dome condensation and the decrease in refrigerator oil concentration (viscosity) while the refrigeration apparatus is stopped.

DESCRIPTION OF EMBODIMENTS

An embodiment and modification of a refrigeration apparatus according to the present invention is described below on the basis of the drawings. The specific configuration of the refrigeration apparatus according to the present invention is not limited to the following embodiment and modification, and can be changed within a range that does not deviate from the scope of the invention.

(1) Basic Configuration of Refrigeration Apparatus

Figure 1:
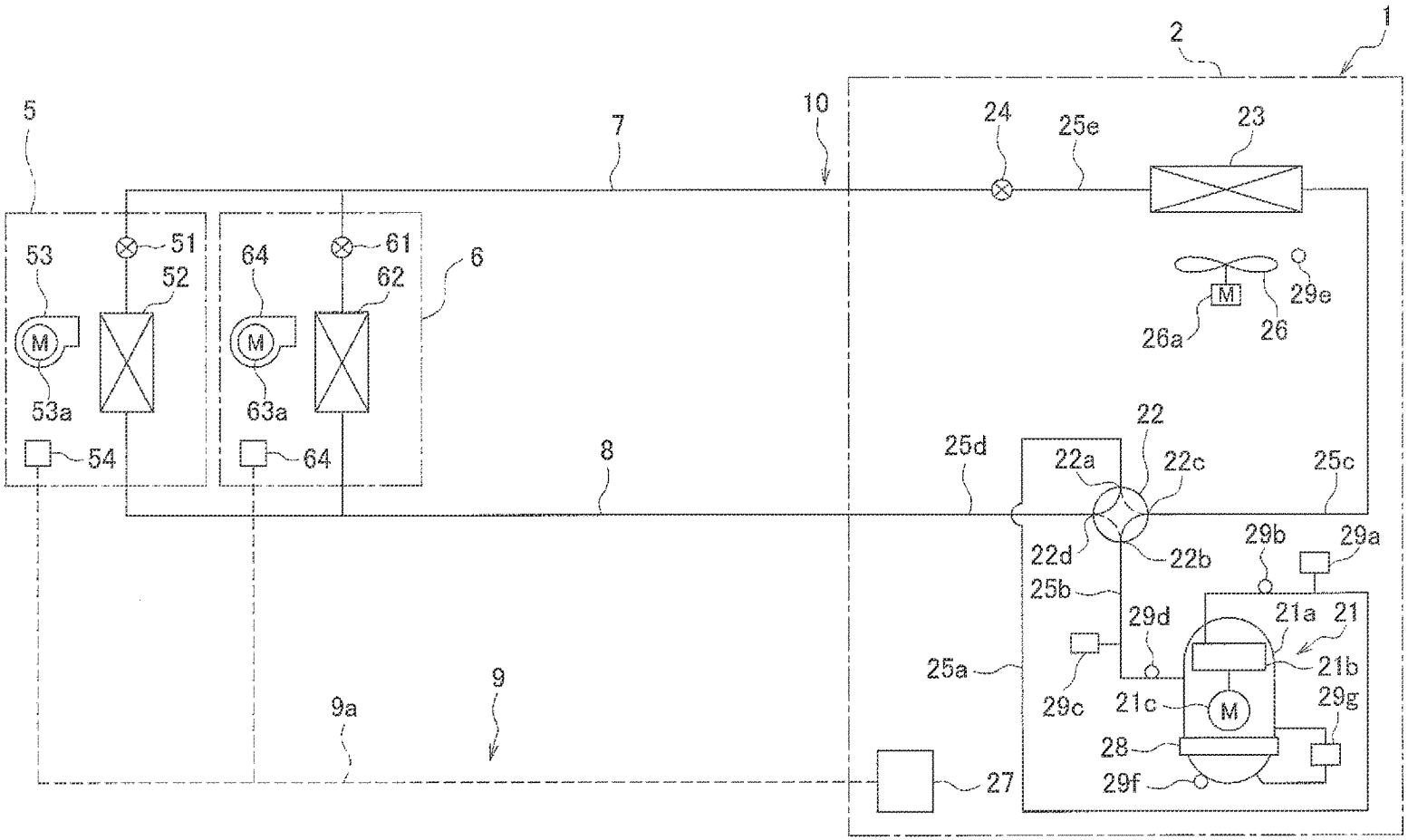
FIG. 1 is a schematic structural diagram of an air-conditioning apparatus as an embodiment of a refrigeration apparatus according to the present invention.

FIG. 1 is a schematic structural diagram of an air-conditioning apparatus 1 as an embodiment of the refrigeration apparatus according to the present invention. The air-conditioning apparatus 1 is an apparatus used to cool and heat the room interior of a building or the like by performing a vapor-compression refrigeration cycle. The air-conditioning apparatus 1 has primarily one outdoor unit 2, a plurality (two in this case) of indoor units 5, 6, and a liquid refrigerant communication pipe 7 and gas refrigerant communication pipe 8 connecting the outdoor unit 2 and the indoor units 5, 6. Specifically, a vapor-compression refrigerant circuit 10 of the air-conditioning apparatus 1 is configured by connecting the outdoor unit 2, the indoor units 5, 6, the liquid refrigerant communication pipe 7, and the gas refrigerant communication pipe 8. The number of indoor units 5, 6 is not limited to two, and may be one, three, or more.

<Indoor Unit>

The indoor units 5, 6 are installed by being embedded in or suspended from ceilings in rooms of a building or the like, or by being mounted on wall surfaces in rooms, or by some other manner. The indoor units 5, 6 are connected to the outdoor unit 2 via the liquid refrigerant communication pipe 7 and the gas refrigerant communication pipe 8, constituting part of the refrigerant circuit 10.

Next, the configuration of the indoor units 5, 6 shall be described. Because the indoor unit 5 and the indoor unit 6 have the same configuration, only the configuration of the indoor unit 5 is described herein, the configuration of the indoor unit 6 is denoted by symbols in the sixties instead of the symbols in the fifties that represent the components of the indoor unit 5, and the components of the indoor unit 6 are not described.

The indoor unit 5 has primarily an indoor expansion valve 51 and an indoor heat exchanger 52.

The indoor expansion valve 51 is a device for adjusting the pressure, flow rate, and other characteristics of the refrigerant flowing through the indoor unit 5. The indoor expansion valve 51 is connected at one end to the liquid side of the indoor heat exchanger 52, and connected at the other end to the liquid refrigerant communication pipe 7. An electric expansion valve is used herein as the indoor expansion valve 51.

The indoor heat exchanger 52 is a heat exchanger that functions as an evaporator of refrigerant to cool indoor air during an air-cooling operation, and functions as a condenser of refrigerant to heat indoor air during an air-warming operation. The indoor heat exchanger 52 is connected on the liquid side to the indoor expansion valve 51, and connected on the gas side to the gas refrigerant communication pipe 8.

The indoor unit 5 has an indoor fan 53 for drawing indoor air into the indoor unit 5, and supplying the air as supply air into the room after the air has undergone heat exchange with the refrigerant in the indoor heat exchanger 52. A centrifugal fan, multiblade fan, or the like driven by an indoor fan motor 53*a* is used herein as the indoor fan 53.

The indoor unit 5 has an indoor-side controller 54 for controlling the actions of the components constituting the indoor unit 5. The indoor-side controller 54, which has a computer, memory, and the like for controlling the indoor unit 5, is configured to be able to exchange control signals and the like with a remote controller (not shown) for separately operating the indoor unit 5, and to be able to exchange control signals and the like with the outdoor unit 2 via a transmission line 9*a*.

<Outdoor Unit>

The outdoor unit 2 is installed on the outside of a building or the like. The outdoor unit 2 is connected to the indoor units 5, 6 via the liquid refrigerant communication pipe 7 and the gas refrigerant communication pipe 8, constituting part of the refrigerant circuit 10.

Next, the configuration of the outdoor unit 2 shall be described. The outdoor unit 2 has primarily a compressor 21, a switching mechanism 22, an outdoor heat exchanger 23, and an outdoor expansion valve 24.

The compressor 21 is a device for compressing low-pressure refrigerant in the refrigeration cycle to a high pressure. The compressor 21 has a hermetically sealed structure in which a positive displacement compression element 21*b* accommodated inside a casing 21*a* is rotatably driven by a compressor motor 21*c*. A first gas refrigerant pipe 25*a* is connected to an intake side of the compressor 21, and a second gas refrigerant pipe 25*b* is connected to a discharge side. The first gas refrigerant pipe 25*a* is a refrigerant pipe connecting the intake side of the compressor 21 and a first port 22*a* of the switching mechanism 22. The second gas refrigerant pipe 25*b* is a refrigerant pipe connecting the discharge side of the compressor 21 and a second port 22*b* of the switching mechanism 22. The compressor 21 is provided with a configuration for controlling the heating of the refrigerator oil inside the compressor 21 while the air-conditioning apparatus 1 is stopped, but the detailed structure of the compressor 21 including the configuration for controlling the heating of the refrigerator oil shall be described hereinafter.

The switching mechanism 22 is a mechanism for switching the direction of refrigerant flow in the refrigerant circuit 10. During the air-cooling operation, the switching mechanism 22 performs a switch that causes the outdoor heat exchanger 23 to function as a condenser of refrigerant compressed in the compressor 21, and causes the indoor heat exchangers 52, 62 to function as evaporators of refrigerant condensed in the outdoor heat exchanger 23. Specifically, during the air-cooling operation, the switching mechanism 22 performs a switch that interconnects the second port 22*b* and a third port 22*c*, and interconnects the first port 22*a* and a fourth port 22*d*. The discharge side of the compressor 21 (the second gas refrigerant pipe 25*b* herein) and the gas side of the outdoor heat exchanger 23 (a third gas refrigerant pipe 25*c* herein) are thereby connected (refer to the solid lines of the switching mechanism 22 in FIG. 1). Moreover, the intake side of the compressor 21 (the first gas refrigerant pipe 25*a* herein) and the gas refrigerant communication pipe 8 side (a fourth gas refrigerant pipe 25*d* herein) are connected (refer to the solid lines of the switching mechanism 22 in FIG. 1). During the air-warming operation, the switching mechanism 22 performs a switch that causes the outdoor heat exchanger 23 to function as an evaporator of refrigerant condensed in the indoor heat exchangers 52, 62, and causes the indoor heat exchangers 52, 62 to function as condensers of refrigerant compressed in the compressor 21. Specifically, during the air-warming operation, the switching mechanism 22 performs a switch that interconnects the second port 22*b* and the fourth port 22*d*, and interconnects the first port 22*a* and the third port 22*c*. The discharge side of the compressor 21 (the second gas refrigerant pipe 25*b* herein) and the gas refrigerant communication pipe 8 side (the fourth gas refrigerant pipe 25*d* herein) are thereby connected (refer to the dashed lines of the switching mechanism 22 in FIG. 1). Moreover, the intake side of the compressor 21 (the first gas refrigerant pipe 25*a* herein) and the gas side of the outdoor heat exchanger 23 (the third gas refrigerant pipe 25*c* herein) are connected (refer to the dashed lines of the switching mechanism 22 in FIG. 1). The third gas refrigerant pipe 25*c* is a refrigerant pipe connecting the third port 22*c* of the switching mechanism 22 and the gas side of the outdoor heat exchanger 23. The fourth gas refrigerant pipe 25*d* is a refrigerant pipe connecting the fourth port 22*d* of the switching mechanism 22 and the gas refrigerant communication pipe 8 side. The switching mechanism 22 herein is a four-way switching valve. The configuration of the switching mechanism 22 herein is not limited to a four-way switching valve, and may be a configuration in which, e.g., a plurality of electromagnetic valves or the like are connected so as to fulfill the switching functions described above.

The outdoor heat exchanger 23 is a heat exchanger that functions as a condenser of refrigerant during the air-cooling operation, and functions as an evaporator of refrigerant during the air-warming operation. The liquid side of the outdoor heat exchanger 23 is connected to a liquid refrigerant pipe 25*e*, and the gas side is connected to the third gas refrigerant pipe 25*c*. The liquid refrigerant pipe 25*e* is a refrigerant pipe connecting the liquid side of the outdoor heat exchanger 23 and the liquid refrigerant communication pipe 7 side.

The outdoor expansion valve 24 is a device for adjusting the pressure, flow rate, and/or other characteristics of the refrigerant flowing through the outdoor unit 2. The outdoor expansion valve 24 is provided to the liquid refrigerant pipe 25*e*. An electric expansion valve is used herein as the outdoor expansion valve 24.

The outdoor unit 2 has an outdoor fan 26 for drawing outdoor air into the outdoor unit 2, and discharging the air out of the outdoor unit 2 after the air has undergone heat exchange with the refrigerant in the outdoor heat exchanger 23. An axial flow fan or the like driven by an outdoor fan motor 26*a* is used herein as the outdoor fan 26.

The outdoor unit 2 has an outdoor-side controller 27 for controlling the actions of the components constituting the outdoor unit 2. The outdoor-side controller 27, which has a microcomputer, memory, and the like for controlling the outdoor unit 2, is configured to be able to exchange control signals and the like with the indoor units 5, 6 (i.e. the indoor-side controllers 54, 64) via the transmission line 9*a*. The outdoor unit 2 is also provided with various sensors used for purposes such as controlling the heating of refrigerator oil inside the compressor 21 while the air-conditioning apparatus 1 is stopped, but these sensors shall be described hereinafter.

<Refrigerant Communication Pipes>

The refrigerant communication pipes 7, 8 are refrigerant pipes that are constructed on site when the air-conditioning apparatus 1 is installed in a building or another location of installation, and pipes having various lengths and/or diameters are used in accordance with the location of installation, the combination of outdoor units and indoor units, and other conditions of installation.

As described above, the refrigerant circuit 10 of the air-conditioning apparatus 1 is configured by connecting the outdoor unit 2, the indoor units 5, 6, and the refrigerant communication pipes 7, 8.

<Controller>

The air-conditioning apparatus 1 is designed so that control of the devices of the outdoor unit 2 and the indoor unit 4 can be performed by a controller 9 configured from the indoor-side controllers 54, 64 and the outdoor-side controller 27. Specifically, a controller 9 for controlling the operation of the air-conditioning apparatus 1 is configured by the indoor-side controllers 54, 64, the outdoor-side controller 27, and the transmission line 9*a* connecting the controllers 27, 54, 64. By switching the switching mechanism 22 to the state shown by the solid lines in FIG. 1 and circulating refrigerant sequentially through the compressor 21, the outdoor heat exchanger 23, the outdoor expansion valve 24, the indoor expansion valves 51, 61, and the indoor heat exchangers 52, 62, the air-cooling operation can be performed. By switching the switching mechanism 22 to the state shown by the dashed lines in FIG. 1 and circulating refrigerant sequentially through the compressor 21, the indoor heat exchangers 52, 62, the indoor expansion valves 51, 61, the outdoor expansion valve 24, and the outdoor heat exchanger 23, the air-warming operation can be performed.

Figure 2:
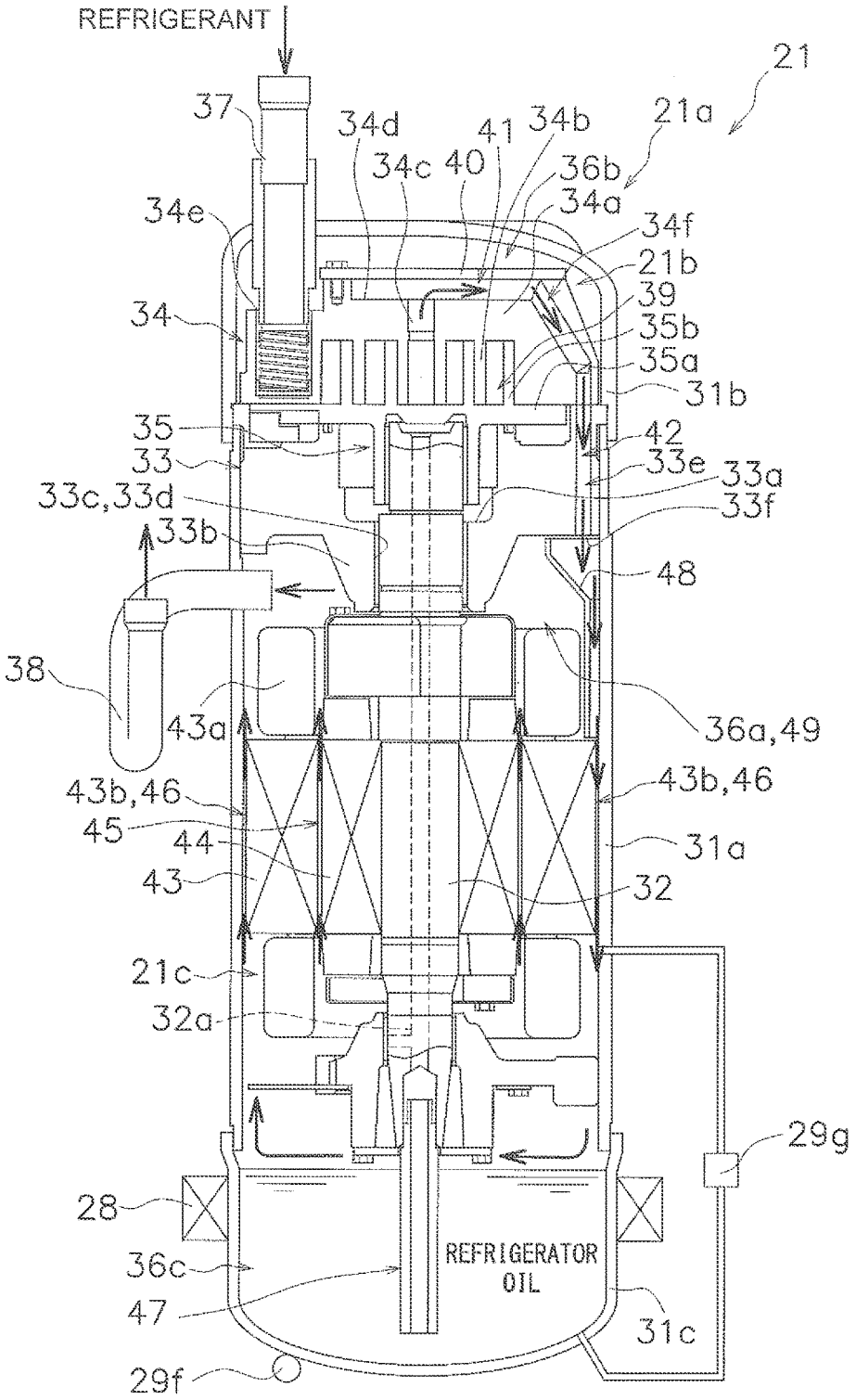
FIG. 2 is a schematic longitudinal cross-sectional view of a compressor.
Figure 3:
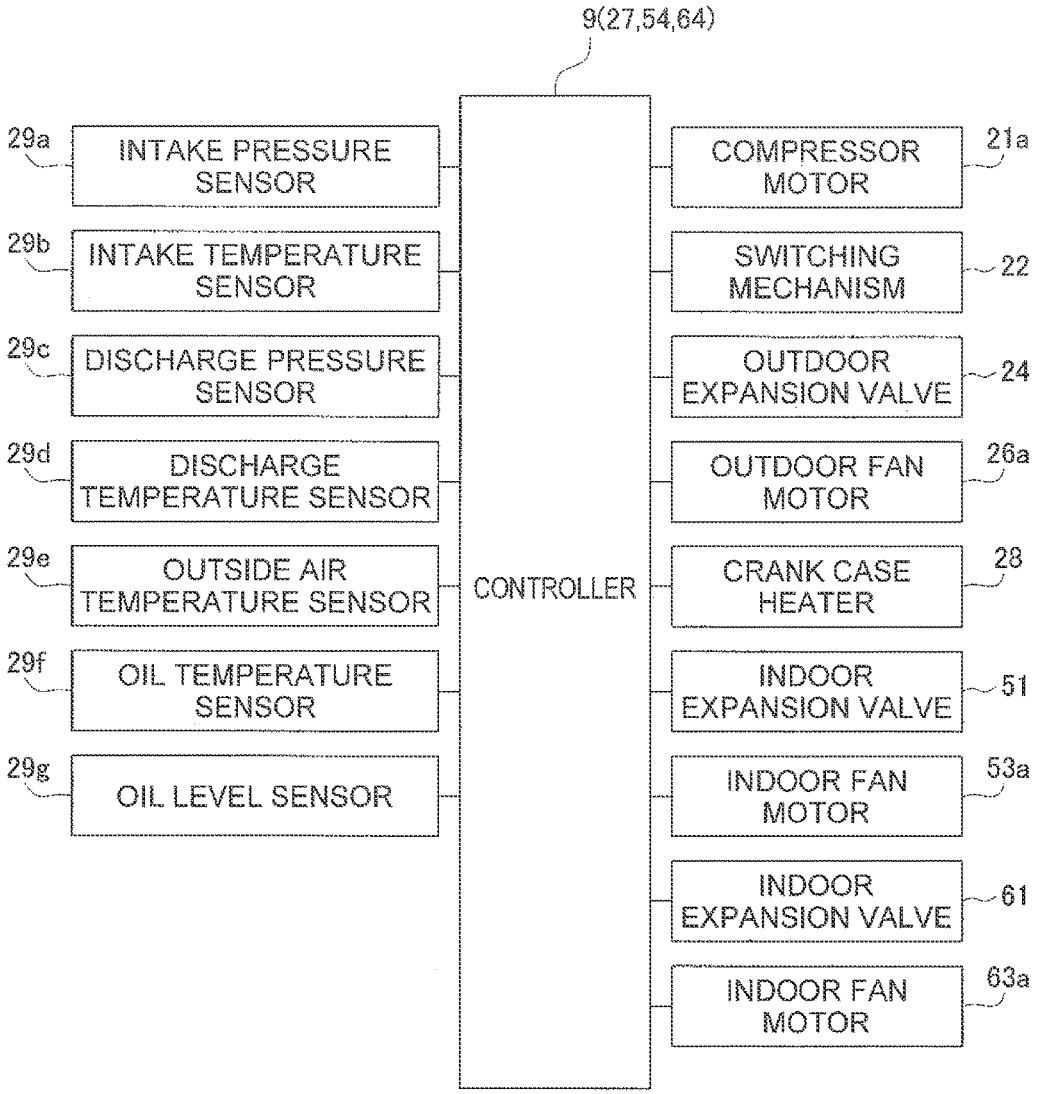
FIG. 3 is a control block diagram of the air-conditioning apparatus.

(2) Detailed Structure of Compressor and Configuration for Controlling Heating of Refrigerator Oil Inside Compressor Next, FIGS. 1 to 3 are used to describe the detailed structure of the compressor 21 and the configuration for controlling the heating of the refrigerator oil inside the compressor 21. FIG. 2 herein is a schematic longitudinal cross-sectional view of the compressor 21. FIG. 3 is a control block diagram of the air-conditioning apparatus 1.

<Basic Structure of Compressor>

The compressor 21 has a casing 21*a* in the shape of an oblong cylinder. The casing 21*a* is a pressure container configured from a casing main body 31*a*, an upper wall part 31*b*, and a bottom wall part 31*c*, the interior of which is hollow. The casing main body 31*a* is a cylindrical barrel part having a vertically extending axis. The upper wall part 31*b* is welded airtight and integrally bonded to the top end of the casing main body 31*a*, and is a bowl-shaped portion having a convex surface protruding upward. The bottom wall part 31*c* is welded airtight and integrally bonded to the bottom end of the casing main body 31*a*, and is a bowl-shaped portion having a convex surface protruding downward.

The interior of the casing 21*a* accommodates the compression element 21*b* for compressing refrigerant, and the compressor motor 21*c* disposed below the compression element 21*b*. The compression element 21*b* and the compressor motor 21*c* are linked by a drive shaft 32 disposed so as to extend vertically inside the casing 21*a*.

The compression element 21*b* has a housing 33, a fixed scroll 34 disposed in close contact with the top of the housing 33, and a movable scroll 35 meshed with the fixed scroll 34. The housing 33 is press-fitted to the casing main body 31*a* in the external peripheral surface through the entire circumferential direction. Specifically, the casing main body 31*a* and the housing 33 are in close airtight contact through their entire peripheries. The inside of the casing 21*a* is divided to a lower high-pressure space 36*a* of the housing 33 and an upper low-pressure space 36*b* of the housing 33. Formed in the housing 33 are a housing concave part 33*a* indented in the middle of the upper surface, and a bearing part 33*b* extending downward from the middle of the lower surface. A bearing hole 33*c* passing through the lower-end surface of the bearing part 33*b* and the bottom surface of the housing concave part 33*a* is formed in the housing 33, and the drive shaft 32 is rotatably fitted into the bearing hole 33*c* via a bearing 33*d*.

In the upper wall part 31*b* of the casing 21*a*, an intake pipe 37 is fitted in an airtight manner for allowing the refrigerant of the refrigerant circuit 10 (the first gas refrigerant pipe 25*a* herein) to flow from the exterior of the casing 21*a* to the interior and guiding the refrigerant to the compression element 21*b*. A discharge pipe 38 for discharging the refrigerant inside the compressor 21 to the outside of the casing 21*a* (the second gas refrigerant pipe 25*b* of the refrigerant circuit 10 herein) is fitted in an airtight matter in the casing main body 31*a*. The intake pipe 37 vertically passes through the low-pressure space 36*b*, and the inner end is fitted in the fixed scroll 34 of the compression element 21*b*.

The lower-end surface of the fixed scroll 34 is in close contact with the upper-end surface of the housing 33. The fixed scroll 34 is fastenably secured to the housing 33 by a bolt (not shown). Sealing the upper-end surface of the housing 33 and the lower-end surface of the fixed scroll 34 ensures that refrigerant of the high-pressure space 36*a* will not leak to the low-pressure space 36*b*.

The fixed scroll 34 has primarily an end plate 34*a*, and a spiraling (involute) lap 34*b* formed on the lower surface of the end plate 34*a*. The movable scroll 35 has primarily an end plate 35*a*, and a spiraling (involute) lap 35*b* formed on the upper surface of the end plate 35*a*. The upper end of the drive shaft 32 is fitted into the movable scroll 35, and the movable scroll is supported in the housing 33 so as to be able to revolve within the housing 33 without being spun by the rotation of the drive shaft 32. The lap 34*b* of the fixed scroll 34 and the lap 35*b* of the movable scroll 35 mesh with each other, whereby a compression room 39 is formed between the fixed scroll 34 and the movable scroll 35. The compression room 39 is configured so as to compress refrigerant by constricting toward the center of the volume between the laps 34*b* and 35*b* along with the revolution of the movable scroll 35.

A discharge port 34*c* interconnected with the compression room 39 and an enlarged concave part 34*d* continuing into the discharge port 34*c* are formed in the end plate 34*a* of the fixed scroll 34. The fixed scroll 34 is a port for discharging refrigerant that has been compressed by the compression room 39, and is formed so as to extend vertically in the middle of the end plate 34*a* of the fixed scroll 34. The enlarged concave part 34*d* is configured from a horizontally widened concave part indented in the upper surface of the end plate 34*a*. A chamber cover 40 is fastenably secured so as to close the enlarged concave part 34*d* in the upper surface of the fixed scroll 34. Covering the enlarged concave part 34*d* with the chamber cover 40 forms a chamber room 41 into which refrigerant flows through the discharge port 34*c* from the compression room 39, the chamber room being positioned on the upper side of the discharge port 34*c*. Specifically, the chamber room 41 is divided from the low-pressure space 36*b* by the chamber cover 40 positioned on the upper side of the discharge port 34*c*. The fixed scroll 34 and the chamber cover 40 are sealed by being in close contact via packing (not shown). Also formed in the fixed scroll 34 is an intake port 34*e* for interconnecting the upper surface of the fixed scroll 34 and the compression room 39 and fitting in the intake pipe 37.

A communication flow channel 42 throughout between the fixed scroll 34 and the housing 33 is formed in the compression element 21*b*. The communication flow channel 42 is a flow channel for allowing refrigerant to flow out from the chamber room 41 to the high-pressure space 36*a*, and is configured from the interconnecting of a scroll-side flow channel 34*f* formed as a recess in the fixed scroll 34, and a housing-side flow channel 33*e* formed as a recess in the housing 33. The upper end of the communication flow channel 42, i.e., the upper end of the scroll-side flow channel 34*f* opens into the enlarged concave part 34*d*, and the lower end of the communication flow channel 42, i.e., the lower end of the housing-side flow channel 33*e* opens into the lower-end surface of the housing 33. A discharge port 33*f* for allowing the refrigerant in the communication flow channel 42 to flow out to the high-pressure space 36*a* is configured by the lower-end opening of the housing-side flow channel 33*e*.

The compressor motor 21*c* is disposed in the high-pressure space 36*a*, and is configured from a motor having an annular stator 43 secured to a wall surface inside the casing 21*a*, and a rotor 44 configured to be free to rotate on the inner peripheral side of the stator 43. Radially between the stator 43 and the rotor 44, an annular gap is formed so as to extend vertically, and this gap constitutes an air gap flow channel 45. A winding coil is fitted on the stator 43, and above and below the stator 43 are coil ends 43*a*.

In the external peripheral surface of the stator 43, core cut parts 43*b* are formed as recesses in a plurality of locations in predetermined gaps in the circumferential direction and from the upper-end surface to the lower-end surface of the stator 43. Due to the core cut parts 43*b* being formed in the external peripheral surface of the stator 43, a plurality of vertically extending motor-cooling flow channels 46 are formed radially between the casing main body 31*a* and the stator 43.

The rotor 44 is drivably linked to the movable scroll 35 of the compression element 21*b* via the drive shaft 32 disposed in the axial center of the casing main body 31*a* so as to extend vertically.

In the space below the compressor motor 21*c*, an oil sump 36*c* for collecting refrigerator oil in the bottom is formed and a pump 47 is set up. The pump 47 is secured to the casing main body 31*a* and attached to the lower end of the drive shaft 32, and is configured so as to pump up the refrigerator oil collected in the oil sump 36*c*. An oil supply channel 32*a* is formed inside the drive shaft 32, and the refrigerator oil pumped up by the pump 47 is supplied through the oil supply channel 32*a* to sliding components of the compression element 21*b* and the like.

A gas guide 48 is provided in the high-pressure space 36*a* so as to join the outlet of the communication flow channel 42 (i.e. the discharge port 33*f*) and part of the motor-cooling flow channels 46 together. The gas guide 48 is a plate-shaped member secured in close contact with the inner wall surface of the casing main body 31*a*. The space between the gas guide 48 and the inner wall surface of the casing main body 31*a* is open in the upper and lower ends. A large part of the refrigerant compressed by the compression element 21*b* and flowing out into the high-pressure space 36*a* from the outlet of the communication flow channel 42 (i.e. the discharge port 33*f*) is thereby sent through the space between the gas guide 48 and the inner wall surface of the casing main body 31*a*, to the motor-cooling flow channels 46. The refrigerant sent to the motor-cooling flow channels 46 heads downward while passing through the motor-cooling flow channels 46, and then arrives in proximity to the oil level of the oil sump 36*c*. The refrigerant that has arrived in proximity to the oil level of the oil sump 36*c* passes through the space vertically between the lower end of the compressor motor 21*c* and the oil level of the oil sump 36*c*, and the refrigerant is then send to the rest of the motor-cooling flow channels 46 (i.e., the motor-cooling flow channels 46 not joined with the lower end of the gas guide 48) and the air gap flow channel 45. The refrigerant sent to the rest of the motor-cooling flow channels 46 and the air gap flow channel heads upward while passing through the rest of the motor-cooling flow channels 46 and the air gap flow channel 45, and then arrives at the discharge pipe 38. Thus, the high-pressure space 36*a* forms a discharge flow channel 49 (herein composed of the gas guide 48, the motor-cooling flow channels 46, and the air gap flow channel 45) for sending the refrigerant compressed by the compression element 21*b* out of the casing 21*a* after the refrigerant has passed through the space vertically between the lower end of the compressor motor 21*c* and the oil level of the oil sump 36*c*.

Thus, the compressor 21 has a structure (referred to as a "high-pressure dome type) structure) in which refrigerant compressed by the single-stage compression element 21*b* is sent out of the casing 21*a* after being discharged into an internal space (the high-pressure space 36*a* herein) of the compressor 21 in which the oil sump 36*c* for collecting refrigerator oil is formed. In the compressor 21, when the compressor motor 21*c* is driven by current conduction during either the air-cooling operation or the air-warming operation, the rotor 44 rotates relative to the stator 43, whereby the drive shaft 32 rotates. When the drive shaft 32 rotates, the movable scroll 35 only revolves without spinning relative to the fixed scroll 34. Consequently, low-pressure refrigerant is thereby drawn through the intake pipe 37 into the compression room 39 from the external-peripheral-edge side of the compression room 39. The refrigerant drawn into the compression room 39 is compressed as the volume of the compression room 39 changes. The refrigerant compressed in the compression room 39 reaches high pressure and flows from the middle of the compression room 39, through the discharge port 34*c*, into the chamber room 41. The high-pressure refrigerant that has flowed into the chamber room 41 flows from the chamber room 41 into the communication flow channel 42, through the scroll-side flow channel 34*f* and the housing-side flow channel 33*e*, and out from the discharge port 33*f* to the high-pressure space 36*a*. The high-pressure refrigerant that has flowed out to the high-pressure space 36*a* passes through the discharge flow channel 49 including the space vertically between the lower end of the compressor motor 21*c* and the oil level of the oil sump 36*c*, arriving at the discharge pipe 38 to be discharged out of the casing 21*a*. The high-pressure refrigerant discharged out of the casing 21*a* circulates through the refrigerant circuit 10, and then becomes low-pressure refrigerant which is drawn back into the compressor 21 through the intake pipe 37.

<Configuration for Controlling Heating of Refrigerator Oil Inside Compressor>

The compressor 21 is provided with a crank case heater 28 as a heater for heating the refrigerator oil collected in the oil sump 36*c* from the external periphery of the casing 21*a*. The crank case heater 28 herein is disposed so as to be wrapped around the bottom wall part 31*c* of the casing 21*a*. The crank case heater 28 is not limited to being disposed on the bottom wall part 31*c*, and may, for example, be disposed on the lower end part of the casing main body 31*a* or another location. The crank case heater 28, similar to other devices, is designed to be controlled by the controller 9.

Various sensors, used for purposes such as controlling the heating of refrigerator oil in the compressor 21, are provided to the air-conditioning apparatus 1. Specifically, the first gas refrigerant pipe 25*a* is provided with an intake pressure sensor 29*a* for detecting the pressure of refrigerant in the intake side of the compressor 21, and an intake temperature sensor 29*b* for detecting the temperature of refrigerant in the intake side of the compressor 21. The second gas refrigerant pipe 25*b* is provided with a discharge pressure sensor 29*c* for detecting the pressure of refrigerant in the discharge side of the compressor 21, and a discharge temperature sensor 29*d* for detecting the temperature of refrigerant in the discharge side of the compressor 21. The outdoor unit 2 is also provided with an outside air temperature sensor 29*e* for detecting the temperature of outdoor air (outside air temperature). Furthermore, the compressor 21 is provided with an oil temperature sensor 29*f* for detecting the temperature of the refrigerator oil collected in the oil sump 36*c*, and an oil level sensor 29*g* for detecting the oil-level height of the refrigerator oil collected in the oil sump 36*c*. These sensors 29*a* to 29*g* are connected to the controller 9 and are designed to be used for purposes such as controlling the heating of the refrigerator oil inside the compressor 21. The temperature of the refrigerator oil collected in the oil sump 36*c* may also be estimated from the detection values of other sensors rather than being detected by the oil temperature sensor 29*f*.

Thus, the air-conditioning apparatus 1 has a compressor 21 having a structure in which refrigerant compressed by the compression element 21*b* is sent out of the casing 21*a* after being discharged to the internal space (the high-pressure space 36*a* herein) of the casing 21*a* in which the oil sump 36*c* for collecting refrigerator oil is formed, a heater (the crank case heater 28 herein) for heating the refrigerator oil collected in the oil sump 36*c*, and a controller 9 for controlling the crank case heater 28.

(3) Heating Control of Refrigerator Oil Inside Compressor, Accounting for in-Dome Condensation In the air-conditioning apparatus 1, similar to conventional practice, the controller 9 is designed to use the crank case heater 28 to heat the refrigerator oil inside the compressor 21 (more specifically, inside the oil sump 36*c*) while the air-conditioning apparatus 1 is stopped (i.e. while the compressor 21 is stopped), in order to prevent refrigerant stagnation in the compressor 21. At this time, when the refrigerator oil inside the oil sump 36*c* is constantly heated while the air-conditioning apparatus 1 is stopped, the standby power of the air-conditioning apparatus 1 increases. Therefore, a conceivable solution for reducing the standby power of the air-conditioning apparatus 1 is that a temperature Toil of the refrigerator oil collected in the oil sump 36*c* be detected by the oil temperature sensor 29*f*, and the crank case heater 28 be controlled so that the temperature Toil of the refrigerator oil reaches a predetermined oil temperature target value. The concentration (viscosity) of the refrigerator oil inside the oil sump 36*c* while the air-conditioning apparatus 1 is stopped can thereby be maintained.

Figure 4:
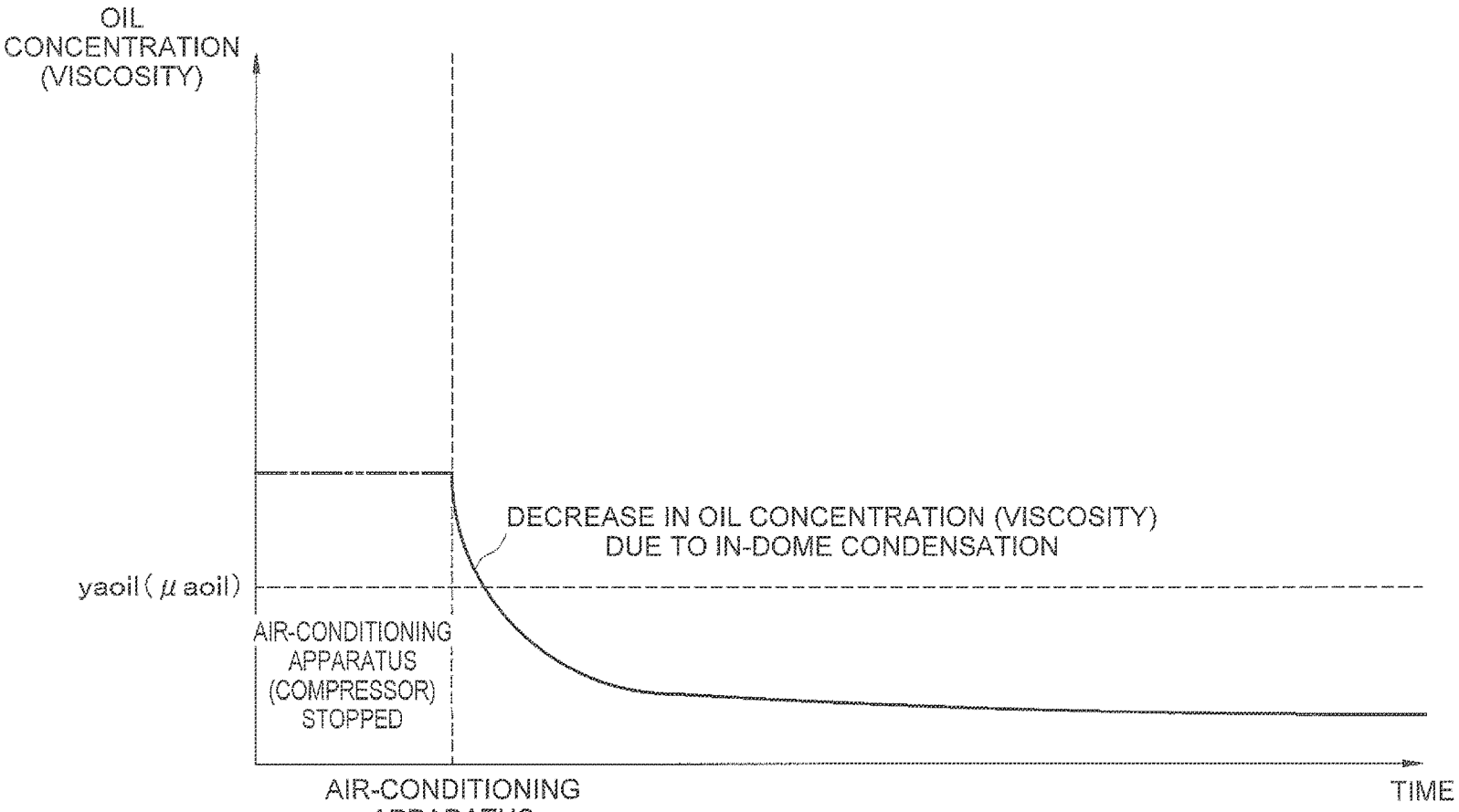
FIG. 4 is a graph showing the change over time in the concentration (viscosity) of the refrigerator oil collected in the oil sump at the start of operation of the air-conditioning apparatus (at startup of the compressor)

However, in-dome condensation occurs because the temperature Toil of the refrigerator oil inside the oil sump 36*c* and/or the temperature of the casing 21*a* of the compressor 21 are low in conditions in which the outside air temperature is low, in-dome condensation being when the refrigerant discharged from the compression element 21*b* for compressing refrigerant into the internal space (the high-pressure space 36*a* herein) of the casing 21*a* at the start of operation of the air-conditioning apparatus 1 (i.e. at startup of the compressor 21) is condensed in the high-pressure space 36*a* before being sent out of the casing 21*a*. As used herein, the phrase in-dome condensation is a phenomenon that occurs when the structure employed for the compressor 21, such as the high-pressure dome type structure employed herein, is one in which the refrigerant compressed by the compression element 21*b* is sent out of the casing 21*a* after being discharged into the high-pressure space 36*a* of the casing 21*a* in which the oil sump 36*c* for collecting refrigerator oil is formed. In in-dome condensation, the refrigerant discharged from the compression element 21*b* into the high-pressure space 36*a* of the casing 21*a* at the start of operation of the air-conditioning apparatus 1 is cooled to a state of saturation in the channel (the discharge flow channel 49 herein) leading out of the casing 21*a*. and the refrigerant condenses on the surface of refrigerator oil collected in the oil sump 36*c* and/or on the surrounding wall surface of the casing 21*a* (refer to the flow of refrigerant inside the compressor 21 in FIG. 2). When the liquid refrigerant produced by such in-dome condensation then dissolves in the refrigerator oil collected in the oil sump 36*c*, there are cases in which at the start of operation of the air-conditioning apparatus 1, the concentration (viscosity) of the refrigerator oil falls below an allowable oil concentration yaoil (allowable oil viscosity μaoil), which is the concentration (viscosity) of refrigerator oil needed to lubricate the compressor 21, such as the case of the change over time in concentration (viscosity) of the refrigerator oil collected in the oil sump 36*c* at the start of operation of the air-conditioning apparatus 1 (at startup of the compressor 21) in FIG. 4. When such low-concentration (low-viscosity) refrigerator oil is supplied to the sliding components of the compressor 21 by the pump 47 and the oil supply channel 32*a* (see FIG. 2), there is a risk that the compressor 21 will not be sufficiently lubricated and the compressor 21 will be unreliable.

A conceivable solution to such in-dome condensation is, similar to Patent Document 4, to provide a wall-surface heating passage for channeling refrigerant discharged from a compressor 21 to a wall surface of the casing 21*a* of the compressor 21, and to channel the refrigerant discharged from the compressor 21 to the wall-surface heating passage to heat the wall surface of the casing 21*a* at the start of operation of the air-conditioning apparatus 1. However, because the refrigerant discharged from the compressor 21 at the start of operation of the air-conditioning apparatus 1 is low in temperature and near a state of saturation, providing the wall-surface heating passage still does not yield heating capacity sufficient to heat the wall surface of the casing 21*a* at the start of operation of the air-conditioning apparatus 1, and it is difficult to suppress decreases of refrigerator oil concentration (viscosity) caused by in-dome condensation.

Thus, a requirement with the air-conditioning apparatus 1 is to make it possible to minimize standby power as well as improve the reliability of the compressor 21 while taking into account the decrease in the concentration (viscosity) of refrigerator oil caused by in-dome condensation at startup of the air-conditioning apparatus 1.

In view of this, the controller 9 herein is designed to control the crank case heater 28 so that while the air-conditioning apparatus 1 is stopped (while the compressor 21 is stopped), the temperature Toil of the refrigerator oil collected in the oil sump 36*c* reaches a first oil temperature target value Ts1oil for keeping the refrigerant condensation amount Mref, which is caused by in-dome condensation at the start of operation of the air-conditioning apparatus 1, equal to or less than an allowable condensation amount Mcref at which the concentration or viscosity of refrigerator oil needed to lubricate the compressor 21 (i.e. the allowable oil concentration yaoil or the allowable oil viscosity μaoil) can be maintained.

Figure 5:
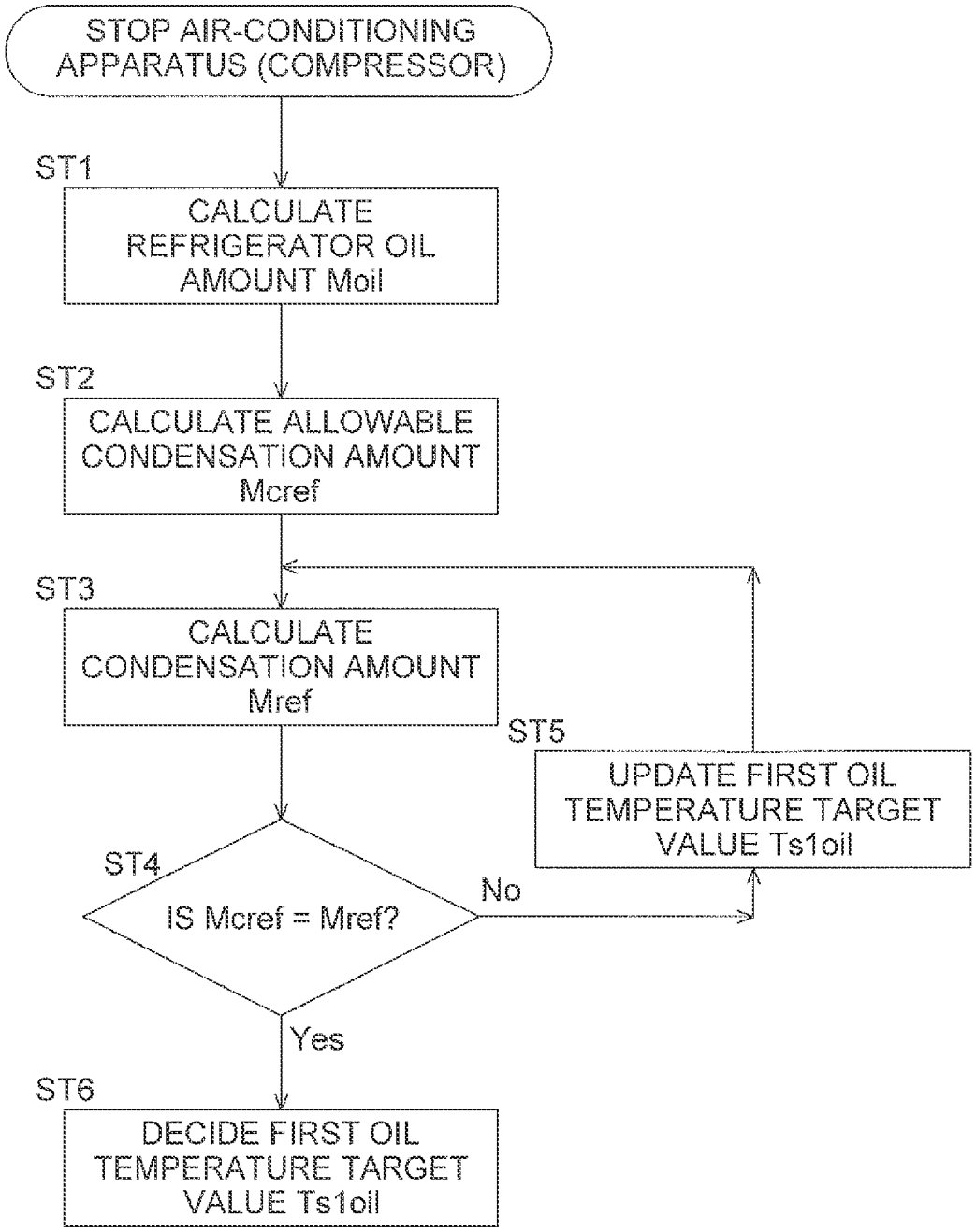
FIG. 5 is a flowchart of heating control (deciding the first oil temperature target value) of the refrigerator oil inside the compressor, accounting for in-dome condensation.
Figure 6:
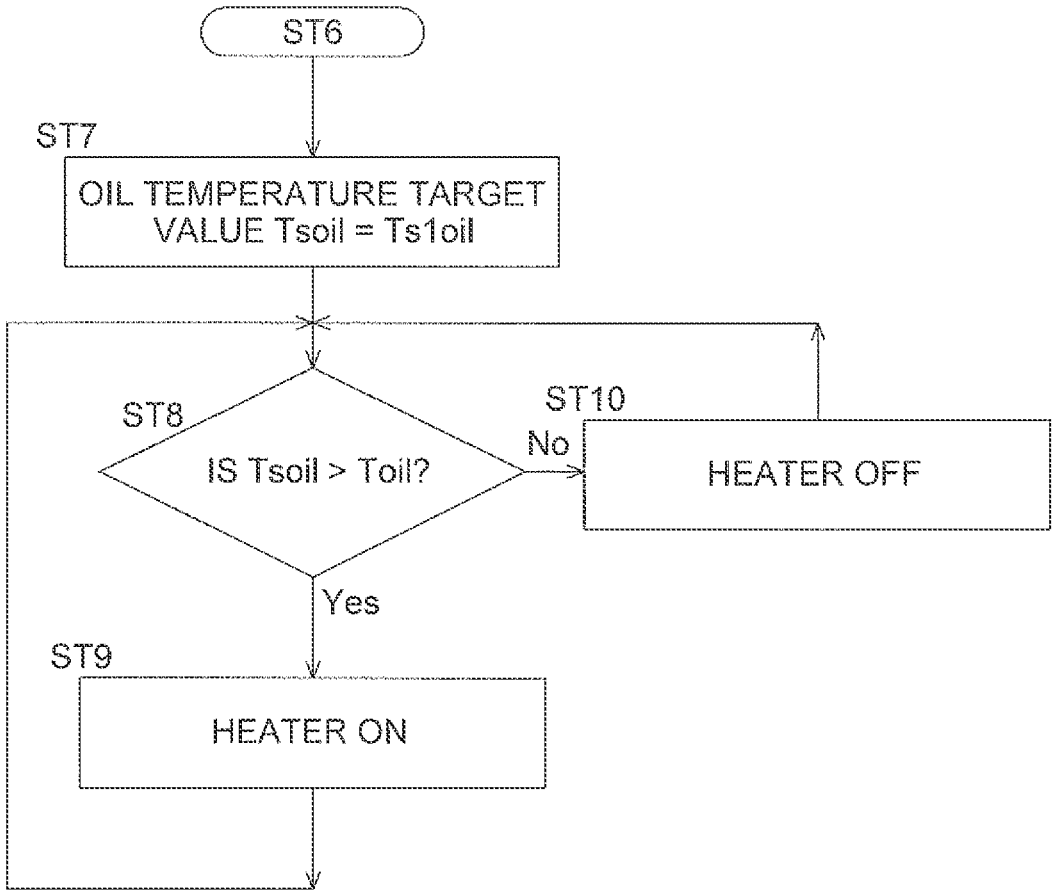
FIG. 6 is a flowchart of heating control (heater control while the air-conditioning apparatus is stopped) of the refrigerator oil inside the compressor, accounting for in-dome condensation.
Figure 7:
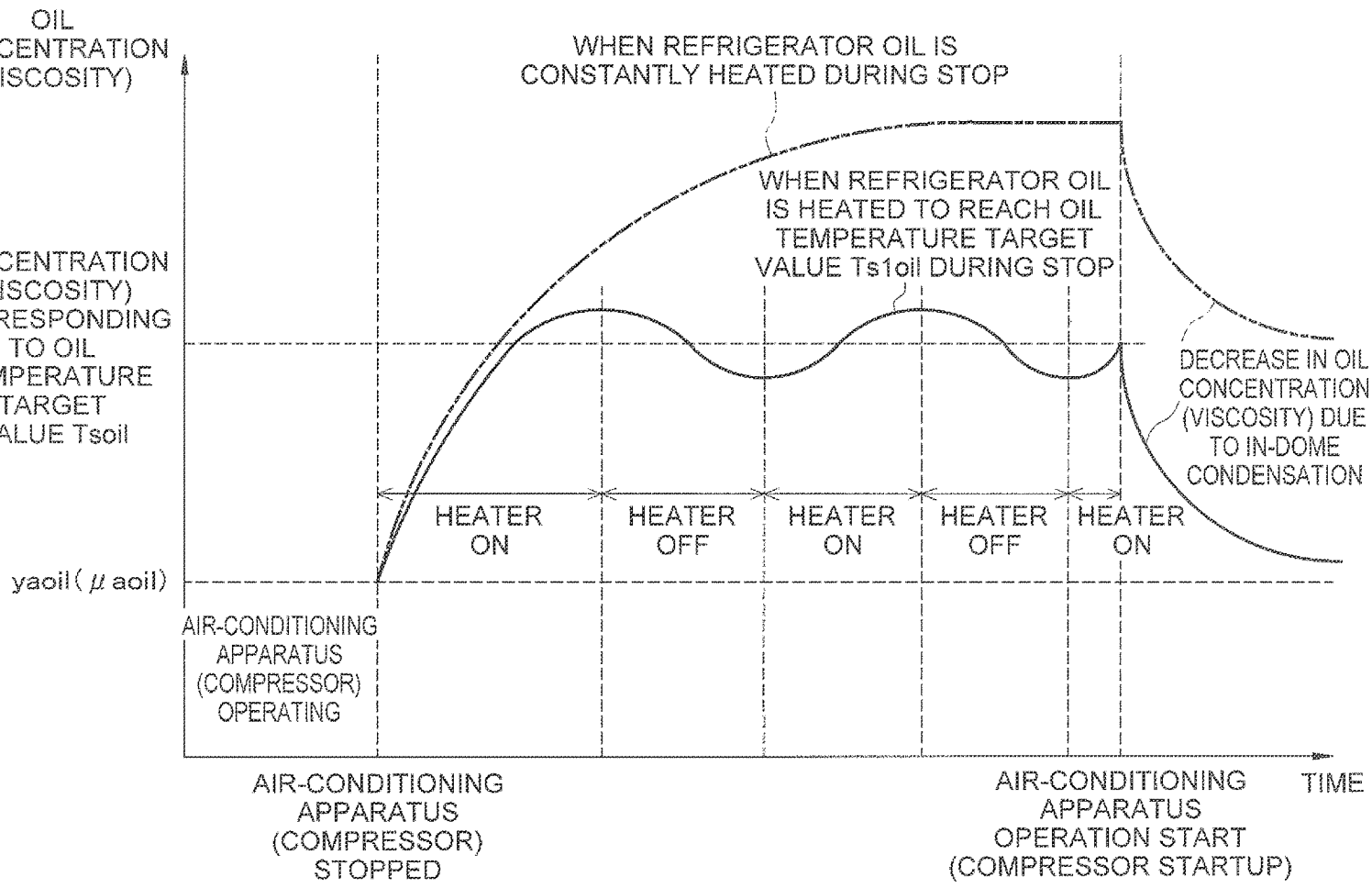
FIG. 7 is a graph showing the change over time in the concentration (viscosity) of the refrigerator oil collected in the oil sump during heating control of the refrigerator oil inside the compressor, accounting for in-dome condensation.

Next, FIGS. 1 to 7 are used to describe heating control of the refrigerator oil inside the compressor 21, accounting for in-dome condensation. FIG. 5 herein is a flowchart of heating control (deciding the first oil temperature target value Ts1oil) of the refrigerator oil inside the compressor 21, accounting for in-dome condensation. FIG. 6 is a flowchart of heating control (heater control while the air-conditioning apparatus 1 is stopped) of the refrigerator oil inside the compressor 21, accounting for in-dome condensation. FIG. 7 is a graph showing the change over time in the concentration (viscosity) of the refrigerator oil collected in the oil sump 36*c* during heating control of the refrigerator oil inside the compressor 21, accounting for in-dome condensation.

<Step ST1: Calculation of Refrigerator Oil Amount Moil>

When the air-conditioning apparatus 1 (the compressor 21) stops, the controller 9 calculates the refrigerator oil amount Moil collected in the oil sump 36*c* while the air-conditioning apparatus 1 is stopped in step ST1. The reason the refrigerator oil amount Moil is calculated is because the extent of the decrease in refrigerator oil concentration (viscosity) caused by in-dome condensation is determined on the basis of the refrigerator oil amount Moil collected in the oil sump 36*c* while the air-conditioning apparatus 1 is stopped, and the refrigerant condensation amount Mref caused by in-dome condensation. The refrigerator oil amount Moil is calculated from the following formula 1-1.

$$Moil = Voil \times \rho \times yoil \qquad \text{formula 1-1}$$

The term Voil represents the volume of refrigerator oil in the oil sump 36*c* while the air-conditioning apparatus 1 is stopped, and this oil volume is calculated on the basis of the oil-level height Loil of refrigerator oil while the air-conditioning apparatus 1 is stopped in the oil sump 36*c* as detected by the oil level sensor 29*g*, and a volume calculation formula obtained from the dimension relationship of the oil sump 36*c*. The symbol ρ represents the mixed density of refrigerant and refrigerator oil in the oil sump 36*c* while the air-conditioning apparatus 1 is stopped. Furthermore, the term yoil represents the concentration of refrigerator oil in the oil sump 36*c* while the air-conditioning apparatus 1 is stopped, and this oil concentration is calculated on the basis of the temperature Toil of the refrigerator oil, the refrigerant pressure Pbd in the high-pressure space 36*a* while the air-conditioning apparatus 1 is stopped in the oil sump 36*c* as detected by the intake pressure sensor 29*a* (or the refrigerant saturation temperature Tbd in the high-pressure space 36*a* obtained by converting the refrigerant pressure Pbd to the saturation temperature), and a saturation solubility relational expression of refrigerant relative to refrigerator oil.

The oil level sensor 29*g* is provided to the compressor 21 herein and is used in the calculation of the refrigerator oil amount Moil, but the method of calculating the refrigerator oil amount Moil is not limited to this option. For example, the refrigerator oil amount Moil may be calculated from the change over time in the refrigerator oil temperature Toil while the air-conditioning apparatus 1 is stopped and/or the operation history of the air-conditioning apparatus 1 until stopping, or the refrigerator oil amount Moil may be a fixed amount determined by referencing standards and other factors. The refrigerant pressure detected by the intake pressure sensor 29*a* is used as the refrigerant pressure Pbd in the high-pressure space 36*a* while the air-conditioning apparatus 1 (the compressor 21) is stopped, but a pressure sensor that directly detects the refrigerant pressure in the high-pressure space 36*a* may be provided to the compressor 21.

<Step ST2: Calculation of Allowable Condensation Amount Mcref>

Next, in step ST2, the controller 9 calculates the allowable condensation amount Mcref at which the concentration or viscosity of refrigerator oil needed to lubricate the compressor 21 (i.e. the allowable oil concentration yaoil or the allowable oil viscosity μaoil) can be maintained, on the basis of the refrigerator oil amount Moil collected in the oil sump 36*c* while the air-conditioning apparatus 1 is stopped, as obtained in step ST1. Specifically, the allowable condensation amount Mcref is calculated from the following formula 2-1.

$$Mcref = Maref - Mbref \quad \text{formula 2-1}$$

The term Maref herein represents the amount of refrigerant present in the oil sump 36*c*, relative to the refrigerator oil amount Moil obtained in step ST1, when the refrigerant is dissolved so as to yield the allowable oil concentration yaoil (or the allowable oil viscosity μaoil), and this refrigerant amount is calculated from the following formula 2-2.

$$Maref = Moil \times (1 - yaoil)/yaoil \quad \text{formula 2-2}$$

The term Mbref represents the amount of refrigerant present in the oil sump 36*c*, relative to the refrigerator oil amount Moil obtained in step ST1, at the point in time immediately before the start of operation of the air-conditioning apparatus 1 (i.e. immediately before startup of the compressor 21), and this refrigerant amount is calculated from the following formula 2-3.

$$Mbref = Moil \times (1 - yboil)/yboil \quad \text{formula 2-3}$$

The term yboil represents the refrigerator oil concentration in the oil sump 36*c* at the point in time immediately before the start of operation of the air-conditioning apparatus 1, and this oil concentration is calculated on the basis of the refrigerator oil temperature Toil in the oil sump 36*c* at the point in time immediately before the start of operation of the air-conditioning apparatus 1, and the saturation solubility relational expression of refrigerant relative to refrigerator oil. Because heater control while the air-conditioning apparatus 1 is stopped in the hereinafter-described steps ST7 to ST10 causes the refrigerator oil temperature Toil in the oil sump 36*c* while the air-conditioning apparatus 1 is stopped to reach the first oil temperature target value Ts1oil as an oil temperature target value Tsoil, the refrigerator oil concentration yboil in the oil sump 36*c* at the point in time immediately before the start of operation of the air-conditioning apparatus 1 is the refrigerator oil concentration at the first oil temperature target value Ts1oil. The first oil temperature target value Ts1oil is a value updated in the processes of step ST2 and the hereinafter-described steps ST3 to ST6, until the refrigerant condensation amount Mref caused by in-dome condensation at the start of operation of the air-conditioning apparatus 1 coincides with the allowable condensation amount Mcref. In the process of the first step ST2 after the air-conditioning apparatus 1 has stopped, the outdoor air temperature Ta detected by the outside air temperature sensor 29*e* is set as the initial value of the first oil temperature target value Ts1oil. However, the initial value of the first oil temperature target value Ts1oil is not limited to the outdoor air temperature Ta.

<Step ST3: Calculation of Refrigerant Condensation Amount Mref Caused by in-Dome Condensation>

Next, in step ST3, the controller 9 predictively calculates the refrigerant condensation amount Mref caused by in-dome condensation at the start of operation of the air-conditioning apparatus 1 (at startup of the compressor 21). The refrigerant condensation amount Mref is caused by the refrigerant, which is discharged from the compression element 21*b* into the high-pressure space 36*a* at the start of operation of the air-conditioning apparatus 1, being cooled and condensed when passing through the discharge flow channel 49. Therefore, a heat radiation model of the refrigerant at the oil level of the oil sump 36*c* is prepared in the form of a transient calculation model, and heat radiation amounts ΔQref for each passage of a predetermined time duration Δt are predictively calculated for the refrigerant at the oil level of the oil sump 36*c* at the start of operation of the air-conditioning apparatus 1. The amounts ΔMref of refrigerant condensed due to heat radiation are calculated from the predictively calculated heat radiation amounts ΔQref, and the refrigerant condensation amount Mref predicted to be caused by in-dome condensation is calculated by adding up these refrigerant condensation amounts ΔMref. Specifically, the refrigerant condensation amount Mref predicted to be caused by in-dome condensation is calculated from the following formula 3-1.

$$Mref = \Sigma \Delta Mref \quad \text{formula 3-1}$$

The symbols ΔMref represent a predicted condensation amount of refrigerant with each passage of a predetermined time duration Δt at the start of operation of the air-conditioning apparatus 1, and the symbol Σ means that the predicted refrigerant condensation amounts ΔMref of each predetermined time duration Δt are added up.

The predicted condensation amount ΔMref of refrigerant of each predetermined time duration Δt is calculated from the following formula 3-2.

$$\Delta Mref = Gref \times (1 - xoutref) \quad \text{formula 3-2}$$

The symbols Gref herein represent the predicted flow rate of refrigerant discharged from the compression element 21*b* into the high-pressure space 36*a* at the start of operation of the air-conditioning apparatus 1, and this flow rate is calculated from the following formula 3-3.

$$Gref = Wc \times Nc \times \rho s \times kc \quad \text{formula 3-3}$$

The term Wc represents the displacement of the compression element 21*b*, and this displacement is a set value of the compressor 21. The term Nc represents the rotational speed of the compressor 21 at the start of operation of the air-conditioning apparatus 1, and this rotational speed is a value determined from a rotational speed setting planned for the start of operation of the air-conditioning apparatus 1. The symbols ρs represent the density of refrigerant drawn into the compression element 21*b* at the start of operation of the air-conditioning apparatus 1, and this density herein is calculated on the basis of the refrigerant pressure Pcs detected by the intake pressure sensor 29*a*, the refrigerant temperature Tcs detected by the intake temperature sensor 29*b*, and a refrigerant pressure-temperature-density relational expression. The term kc represents volumetric efficiency. The term xoutref represents the dryness of the refrigerant that has been discharged from the compression element 21*b* into the high-pressure space 36*a* and has radiated heat at the oil level of the oil sump 36*c* at the start of operation of the air-conditioning apparatus 1. The enthalpy ioutref of the refrigerant, which has been discharged from the compression element 21*b* into the high-pressure space 36*a* and has radiated heat at the oil level of the oil sump 36*c* at the start of operation of the air-conditioning apparatus 1, is calculated from the following formula 3-4, and the refrigerant dryness is calculated on the basis of the refrigerant enthalpy ioutref obtained by calculation, the refrigerant pressure Pcd detected by the discharge pressure sensor 29*c* of the air-conditioning apparatus 1, and a refrigerant pressure-enthalpy-dryness relational equation.

$$i\text{outref}=i\text{inref}-\Delta Q\text{ref}/G\text{ref} \quad \text{formula 3-4}$$

The term iinref represents the enthalpy of the refrigerant before being discharged from the compression element 21*b* into the high-pressure space 36*a* and radiating heat at the oil level of the oil sump 36*c* at the start of operation of the air-conditioning apparatus 1, and this enthalpy is calculated on the basis of a refrigerant pressure-temperature-enthalpy relational expression, substituting the refrigerant pressure Pcd detected by the discharge pressure sensor 29*c* of the air-conditioning apparatus 1, and the refrigerant temperature Tinref detected by the discharge temperature sensor 29*d*. The enthalyph iinref may also be estimated using a calculation model for estimating the heat loss in the channel leading from the compression element 21*b* to the oil level of the oil sump 36*c*, from the refrigerant intake temperature Tcs. When data of the previous start of operation of the air-conditioning apparatus 1 is available, the enthalpy iinref can be predicted from the refrigerant discharge temperature.

The predicted heat radiation amount ΔQref of refrigerant with each predetermined time duration Δt is calculated from the following formulas 3-5 to 3-9.

$$\Delta Q\text{ref}=k\text{ref}\times h\text{ref}\times A\text{ref}\times(T\text{inref}-Ts1\text{oil}) \quad \text{formula 3-5}$$

$$h\text{ref}=Nu\times\lambda\text{ref}/D\text{ref} \quad \text{formula 3-6}$$

$$Nu=C\times Re\hat{}\alpha\times Pr\hat{}\beta \quad \text{formula 3-7}$$

$$Re=D\text{ref}\times G\text{ref}\times\rho\text{ref}/\mu\text{ref} \quad \text{formula 3-8}$$

$$Pr=Cp\text{ref}\times\mu\text{ref}/\lambda\text{ref} \quad \text{formula 3-9}$$

The term kref represents a correction coefficient of the heat-transfer coefficient href between refrigerant and refrigerator oil at the oil level of the oil sump 36*c*, and this correction coefficient is set appropriately when the dryness xinref is less than 1 (a wet state) of refrigerant yet to be discharged from the compression element 21*b* into the high-pressure space 36*a* and yet to radiate heat at the oil level of the oil sump 36*c* at the start of operation of the air-conditioning apparatus 1. The refrigerant dryness xinref is calculated on the basis of the refrigerant enthalpy iinref, the refrigerant pressure Pcd detected by the discharge pressure sensor 29*c* of the air-conditioning apparatus 1, and a refrigerant pressure-enthalpy-dryness relational expression. The heat-transfer coefficient href is calculated by the relational expressions 3-6 to 3-9 of the Nusselt number Nu. Reynolds number Re, and Prandtl number Pr, often used in conventional practice to calculate heat-transfer coefficients. The symbols λref, ρref, μref, and Cpref represent the heat-transfer coefficient, density, viscosity, and constant pressure specific heat of the refrigerant at the oil level of the oil sump 36*c*, and these values are calculated on the basis of the refrigerant pressure Pcd detected by the discharge pressure sensor 29*c* of the air-conditioning apparatus 1, the refrigerant temperature Tcd detected by the discharge temperature sensor 29*d*, a refrigerant pressure-temperature-heat-transfer coefficient relational expression, a refrigerant pressure-temperature-density relational expression, a refrigerant pressure-temperature-viscosity relational expression, and a refrigerant pressure-temperature-constant pressure specific heat relational expression. The term Dref represents characteristic length, the symbols C, α, and β represent relational expression coefficients of the Nusselt number Nu, the Reynolds number Re, and the Prandtl number Pr, and these values are determined experimentally. The term Aref represents the surface area of the oil level of the oil sump 36*c*.

Thus, in step ST3, the predicted condensation amount Mref of refrigerant is calculated using the above formulas 3-1 to 3-9. In the process of the first step ST3 following the stopping of the air-conditioning apparatus 1, the predicted condensation amount Mref of refrigerant is calculated using the initial value of the first oil temperature target value Ts1oil (the outdoor air temperature Ta herein).

A predicted condensation amount Mref of the refrigerant caused by in-dome condensation at the start of operation of the air-conditioning apparatus 1 (at startup of the compressor 21) is herein obtained by a transient calculation of a heat radiation model of the refrigerant at the oil level of the oil sump 36*c*, but the predicted condensation amount is not limited to being obtained in this manner. For example, the predicted condensation amount Mref of the refrigerant may be obtained from actual operation data at the previous start of operation of the air-conditioning apparatus 1, or the predicted condensation amount Mref of the refrigerant may be obtained assuming typical startup operation control of the air-conditioning apparatus 1. The first oil temperature target value Ts1oil may also be prepared by calculation in advance in order to reduce the amount of calculation as much as possible. For example, a relational expression and/or table of refrigerant predicted condensation amounts Mref—first oil temperature target values Ts1oil may be prepared, and the first oil temperature target value Ts1oil may be determined from the obtained refrigerant predicted condensation amount Mref.

<Steps ST4 to ST6: Determination of First Oil Temperature Target Value Ts1oil>

Next, in step ST4, the controller 9 assesses whether or not the allowable condensation amount Mcref decided in step ST2 and the predicted condensation amount Mref decided in step ST3 coincide. In the process of the first step ST4 after the stopping of the air-conditioning apparatus 1, it is assessed whether or not the predicted condensation amount Mref coincides with the allowable condensation amount Mcref calculated using the initial value of the first oil temperature target value Ts1oil (the outdoor air temperature Ta herein).

When the allowable condensation amount Mcref and the predicted condensation amount Mref do not coincide, the sequence transitions to the process of step ST5, and the first oil temperature target value Ts1oil is updated. When the predicted condensation amount Mref herein is greater than the allowable condensation amount Mcref, the first oil temperature target value Ts1oil is updated so as to be higher, and when the predicted condensation amount Mref is less than the allowable condensation amount Mcref, the first oil temperature target value Ts1oil is updated so as to be lower.

Returning to steps ST2 and ST3, the allowable condensation amount Mcref and the predicted condensation amount Mref are calculated again using the updated first oil temperature target value Ts1oil, and it is again assessed in step ST4 whether or not the predicted condensation amount Mref coincides with the allowable condensation amount Mcref.

After these processes of steps ST2 to ST5 are repeated until the predicted condensation amount Mref coincides with the allowable condensation amount Mcref, the sequence transitions to step ST6. A first oil temperature target value Ts1oil is thereby decided at which the refrigerant condensation amount Mref, caused by in-dome condensation at the start of operation of the air-conditioning apparatus 1, can be kept equal to or less than the allowable condensation amount Mcref at which the concentration or viscosity of refrigerator oil needed to lubricate the compressor 21 (i.e., the allowable oil concentration yaoil or allowable oil viscosity μaoil) can be maintained.

<Steps ST7 to ST10: Heater Control while Air-Conditioning Apparatus 1 is Stopped>

Next, in step ST7, the controller 9 sets the first oil temperature target value Ts1oil obtained in step ST6 as the oil temperature target value Tsoil for heater control while the air-conditioning apparatus 1 (the compressor 21) is stopped.

In step ST8, the controller 9 compares the temperature Toil of refrigerator oil in the oil sump 36*c* and the oil temperature target value Tsoil, and when the refrigerator oil temperature Toil has not reached the oil temperature target value Tsoil, the sequence transitions to the process of step ST9 and the crank case heater 28 is turned on to heat the refrigerator oil. When the refrigerator oil temperature Toil in the oil sump 36*c* and the oil temperature target value Tsoil are compared and the refrigerator oil temperature Toil has reached the oil temperature target value Tsoil, the sequence transitions to the process of step ST10 and the crank case heater 28 is turned off to suspend the heating of the refrigerator oil. Performing these processes of steps ST8 to ST10 ensures that the refrigerator oil temperature Toil in the oil sump 36*c* will reach the oil temperature target value Tsoil (the first oil temperature target value Ts1oil herein) while the air-conditioning apparatus 1 is stopped.

By controlling the heating of refrigerator oil inside the compressor 21 while accounting for in-dome condensation as described above, it is possible herein to heat the refrigerator oil while the air-conditioning apparatus 1 (the compressor 21) is stopped until the temperature Toil of refrigerator oil collected in the oil sump 36*c* reaches the oil temperature target value Tsoil (the first oil temperature target value Ts1oil herein) accounting for the decrease in concentration (viscosity) of the refrigerator oil caused by in-dome condensation at the start of operation of the air-conditioning apparatus 1 (refer to the state of the air-conditioning apparatus 1 while stopped in FIG. 7). It is thereby possible to maintain the concentration (viscosity) of refrigerator oil needed to lubricate the compressor at the start of operation of the air-conditioning apparatus 1 even if in-dome condensation occurs (refer to the state of the air-conditioning apparatus 1 at the start of operation in FIG. 7). Limiting the extent of heating the refrigerator oil collected in the oil sump 36*c* to the oil temperature target value Tsoil (the first oil temperature target value Ts1oil herein) makes it possible to reduce the power consumption of the crank case heater 28, and consequently the standby power of the air-conditioning apparatus 1, more so than when the refrigerator oil is constantly heated while the air-conditioning apparatus 1 is stopped (refer to the state of the air-conditioning apparatus 1 while stopped in FIG. 7).

It is thereby possible hereinto minimize the standby power of the air-conditioning apparatus 1 as well as improve the reliability of the compressor 21 while taking into account the decrease in refrigerator oil concentration (viscosity) caused by in-dome condensation.

Moreover, the allowable condensation amount Mcref is decided on the basis of the amount Moil of refrigerator oil collected in the oil sump 36*c* while the air-conditioning apparatus 1 is stopped, after which the first oil temperature target value Ts1oil is decided so that the refrigerant condensation amount Mref caused by in-dome condensation will be equal to or less than the allowable condensation amount Mcref, and an appropriate first oil temperature target value Ts1oil can therefore be obtained.

(4) Modification 1

In the heating control of the refrigerator oil inside the compressor 21 in the above embodiment, the first oil temperature target value Ts1oil, which accounts for the decrease in refrigerator oil concentration (viscosity) caused by in-dome condensation at the start of operation of the air-conditioning apparatus 1 (at startup of the compressor 21), is designated as the oil temperature target value Tsoil. Heating control of the refrigerator oil inside the compressor 21 herein is performed with consideration given to the decrease in refrigerator oil concentration (viscosity) while the air-conditioning apparatus 1 (the compressor 21) is stopped, in addition to in-dome condensation.

Figure 8:
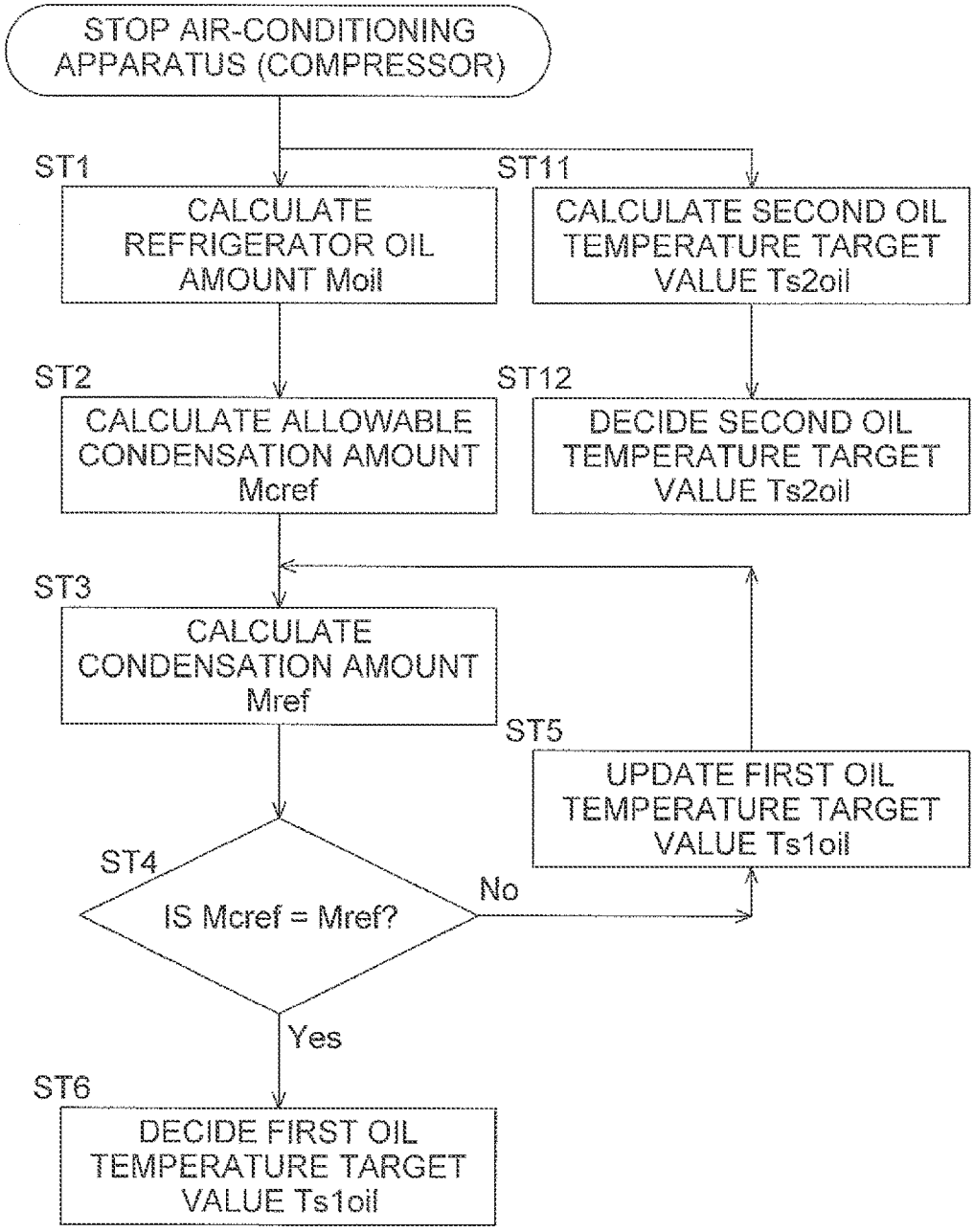
FIG. 8 is a flowchart of heating control (deciding a first oil temperature target value and a second oil temperature target value) of the refrigerator oil inside the compressor in Modification 1.

Specifically, in steps ST11 and ST12, the controller 9 herein decides a second oil temperature target value Ts2oil that accounts for the refrigerator oil concentration (viscosity) while the air-conditioning apparatus 1 is stopped, in parallel with the process of deciding the first oil temperature target value Ts1oil in steps ST1 to ST6, as shown in FIG. 8.

The second oil temperature target value Ts2oil is an oil temperature target value at which the concentration or viscosity of refrigerator oil collected in the oil sump 36*c* in a state of solution equilibrium can be maintained at the concentration or viscosity of refrigerator oil needed to lubricate the compressor 21 while the refrigeration apparatus 1 is stopped. The term "state of solution equilibrium" means a state in which at the refrigerant pressure Pbd in the high-pressure space 36*a* which is the internal space of the casing 21*a*, the refrigerant in the refrigerator oil collected in the oil sump 36*c* has reached a saturation solubility. Therefore, the second oil temperature target value Ts2oil can be calculated from, e.g., a polynomial of the refrigerant saturation temperature Tbd of the high-pressure space 36*a* obtained by converting the refrigerant pressure Pbd to a saturation temperature.

$$Ts2\text{oil}=C1\times Tbd^{\wedge}2+C2\times Tbd+C3+Tbd$$

Figure 9:
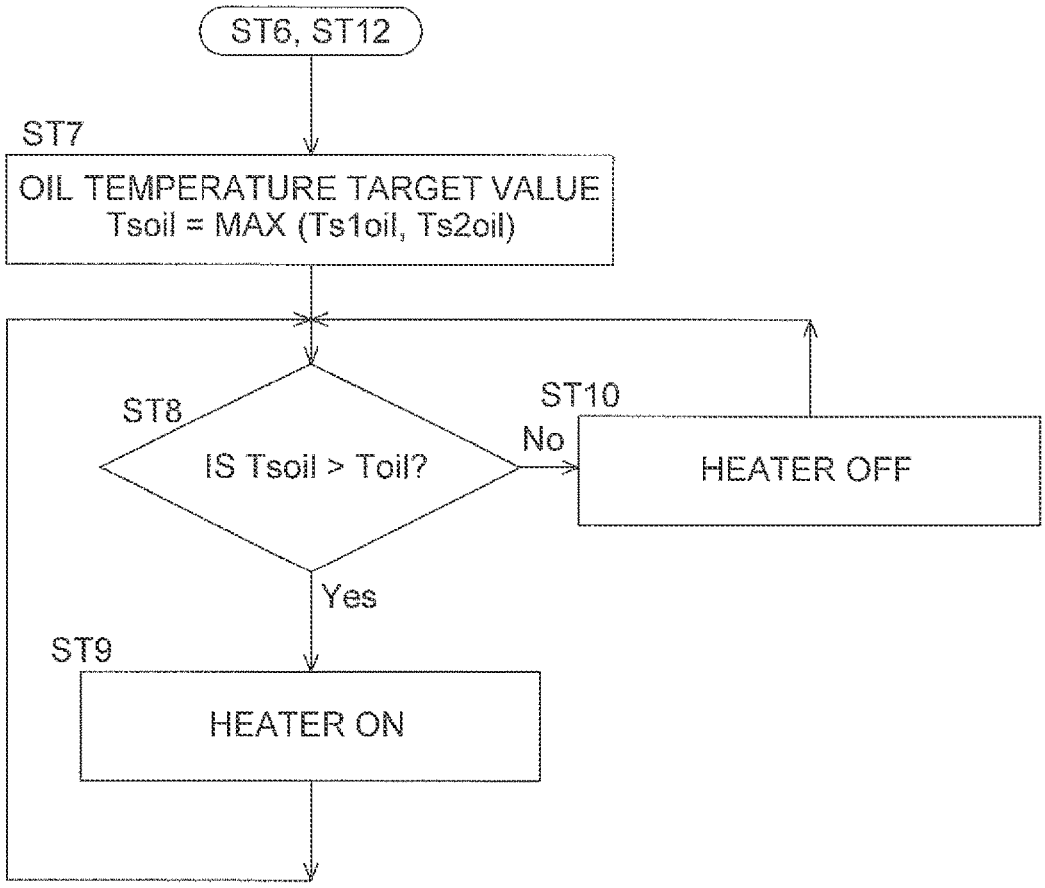
FIG. 9 is a flowchart of heating control (heater control while the air-conditioning apparatus is stopped) of the refrigerator oil inside the compressor in Modification 1.

In step ST7, the controller 9 compares the second oil temperature target value Ts2oil decided in steps ST11 and ST12 and the first oil temperature target value Ts1oil decided in steps ST1 to ST6, sets the higher of the two as the oil temperature target value Tsoil, and performs the heater control of steps ST8 to ST10, as shown in FIG. 9.

Thus, while the air-conditioning apparatus 1 is stopped, the refrigerator oil is heated until the temperature Toil of refrigerator oil collected in the oil sump 36*c* reaches the oil temperature target value Tsoil (i.e. the higher value of the first oil temperature target value Ts1oil and the second oil temperature target value Ts2oil), which accounts for the decrease in refrigerator oil concentration (viscosity) while the air-conditioning apparatus 1 is stopped as well as the decrease in refrigerator oil concentration (viscosity) caused by in-dome condensation at the start of operation of the air-conditioning apparatus 1. The refrigerator oil concentration or viscosity needed to lubricate the compressor 21 can thereby be maintained throughout the stopping of the air-conditioning apparatus 1 and the start of operation of the air-conditioning apparatus 1.

It is thereby possible to minimize the standby power of the air-conditioning apparatus 1 as well as improve the reliability of the compressor 21, while taking into account the decrease in refrigerator oil concentration (viscosity) caused by in-dome condensation and the decrease in refrigerator oil concentration (viscosity) while the air-conditioning apparatus 1 is stopped.

(5) Other Modifications

<A>

In the above embodiment and Modification 1, the crank case heater 28 is used as the heater for heating the refrigerator oil, but the heater is not limited to this option. For example, the refrigerator oil may be heated by open-phase current conduction to the compressor motor 21*c*, instead of being heated by the crank case heater 28. The heater may also be disposed inside the casing 21*a*, rather than being disposed as wrapped around the external periphery of the casing 21*a*.

<B>

In the above embodiment and Modification 1, the compressor 21 having a high-pressure dome structure with a single-stage compression element 21*b* is employed as a compressor having a structure in which refrigerant compressed by the compression element is sent out of the casing after being discharged into the internal space of the casing in which the oil sump for collecting refrigerator oil is formed, but the compressor is not limited to this option. For example, when a compressor having a multiple-stage compression element is employed, the compressor may have an intermediate-pressure dome structure or a high-pressure dome structure in which the refrigerant compressed by an intermediate-stage or final-stage compression element is sent out of the casing after being discharged into the internal space of the casing.

The compression element constituting the compressor is not limited to a scroll-type element, and may be a rotary or other type of compression element.

<C>

In the above embodiment and Modification 1, the present invention was applied to an air-conditioning apparatus 1 having a refrigerant circuit 10 capable of switching between an air-cooling operation and an air-warming operation, but the invention is not limited to such an apparatus. For example, the present invention may be applied to a refrigeration apparatus having another refrigerant circuit dedicated for a single purpose such as air-cooling.

INDUSTRIAL APPLICABILITY

The present invention is widely applicable to refrigeration apparatuses that comprise a compressor having a structure in which refrigerant compressed by a compression element is sent out of a casing after being discharged into an internal space of the casing in which an oil sump for collecting refrigerator oil is formed, a heater for heating the refrigerator oil collected in the oil sump, and a controller for controlling the heater.

What is claimed is:

1. A refrigeration apparatus, comprising:

a compressor having a casing, a compression element and a structure arranged so that refrigerant compressed by the compression element is sent out of the casing after being discharged into an internal space of the casing, an oil sump being formed in the casing to collect refrigerator oil, and a heater being disposed in the casing to heat the refrigerator oil collected in the oil sump; and a controller configured to control the heater while the refrigeration apparatus is stopped so that a temperature of the refrigerator oil collected in the oil sump reaches a first oil temperature target value, the controller being further configured to set the first oil temperature target value in order to keep a refrigerant condensation amount of the refrigerant equal to or less than an allowable condensation amount at which the concentration or viscosity of the refrigerator oil needed to lubricate the compressor can be maintained, with the refrigerant condensation amount being caused by in-dome condensation in which the refrigerant discharged from the compression element into the internal space at the start of operation of the refrigeration apparatus is condensed in the internal space before being sent out of the casing.

2. The refrigeration apparatus according to claim 1, wherein the controller is further configured to determine the allowable condensation amount based on an amount of the refrigerator oil collected in the oil sump while the refrigeration apparatus is stopped, and to set the first oil temperature target value so that the refrigerant condensation amount caused by the in-dome condensation is equal to or less than the allowable condensation amount.

3. The refrigeration apparatus according to claim 1, wherein while the refrigeration apparatus is stopped, the controller is further configured to determine a second oil temperature target value at which the concentration or viscosity of the refrigerator oil collected in the oil sump in a state of solution equilibrium can be maintained at a concentration or viscosity of the refrigerator oil needed to lubricate the compressor, and to control the heater so that the temperature of the refrigerator oil collected in the oil sump reaches a higher one of the first oil temperature target value and the second oil temperature target value.

4. The refrigeration apparatus according to claim 2, wherein while the refrigeration apparatus is stopped, the controller is further configured to determine a second oil temperature target value at which the concentration or viscosity of the refrigerator oil collected in the oil sump in a state of solution equilibrium can be maintained at a concentration or viscosity of the refrigerator oil needed to lubricate the compressor, and to control the heater so that the temperature of the refrigerator oil collected in the oil sump reaches a higher one of the first oil temperature target value and the second oil temperature target value.

* * * * *